US011387567B1

(12) United States Patent
Watson

(10) Patent No.: US 11,387,567 B1
(45) Date of Patent: Jul. 12, 2022

(54) MULTIBAND ANTENNA WITH DIPOLE RESONANT STRUCTURES

(71) Applicant: Communication Components Antenna Inc., Kanata (CA)

(72) Inventor: Paul Watson, Kanata (CA)

(73) Assignee: Communication Components Antenna Inc., Kanata (CA)

( * ) Notice: Subject to any disclaimer, the term of this patent is extended or adjusted under 35 U.S.C. 154(b) by 0 days.

(21) Appl. No.: 17/175,468

(22) Filed: Feb. 12, 2021

(51) Int. Cl.

| | |
|---|---|
| ***H01Q 21/26*** | (2006.01) |
| ***H01Q 19/10*** | (2006.01) |
| ***H01Q 21/06*** | (2006.01) |
| *H01Q 5/307* | (2015.01) |
| *H01Q 21/00* | (2006.01) |
| *H01Q 15/14* | (2006.01) |
| *H01Q 9/32* | (2006.01) |
| *H01Q 1/38* | (2006.01) |

(52) U.S. Cl.
CPC ..... *H01Q 19/108* (2013.01); *H01Q 21/062* (2013.01); *H01Q 21/26* (2013.01); *H01Q 1/38* (2013.01); *H01Q 5/307* (2015.01); *H01Q 9/32* (2013.01); *H01Q 15/14* (2013.01); *H01Q 21/0006* (2013.01)

(58) Field of Classification Search
CPC .... H01Q 19/108; H01Q 21/062; H01Q 21/26; H01Q 9/32; H01Q 21/0006; H01Q 15/14; H01Q 1/38
See application file for complete search history.

(56) References Cited

U.S. PATENT DOCUMENTS

2020/0028277 A1* 1/2020 Watson ..... H01Q 21/26

* cited by examiner

*Primary Examiner* — Joseph J Lauture
(74) *Attorney, Agent, or Firm* — Sofer & Haroun, LLP

(57) ABSTRACT

An antenna for cellular communications is provided having a reflector and at least a first array of dipole antenna elements on the reflector operating at a first frequency ban. The dipole antenna elements of the first array having a printed circuit construction and composed of a balun feed and dipole arms. At least a second array of dipole antenna elements is provided on the reflector operating at a second frequency band the dipole antenna elements of the first array having a printed circuit construction and composed of a balun feed and dipole arms. The dipole antenna elements of the first array include one or more resonant structures causing a substantially closed circuit at the first frequency band and a substantially open circuit at the second frequency band. The resonant structures on the dipole antenna elements of the first array are located at least in part on the balun feed of the dipole antenna elements.

13 Claims, 25 Drawing Sheets

| Curve info |
| --- |
| St(p2,p1) Setup1: Sweep |
| St(p1,p1) Setup1: Sweep |
| St(p3,p3) Setup1: Sweep |

| Name | Freq | Ang | Mag | RX |
| --- | --- | --- | --- | --- |
| m1 | 0.9436 | -36.3294 | 0.9927 | 0.0379-3.0474i |
| m2 | 1.7220 | 95.0000 | 0.9557 | 0.0146+0.9155i |
| m3 | 2.6841 | -83.7099 | 0.9241 | 0.0885-1.1124i |
| m4 | 2.2031 | 23.0165 | 0.9085 | 1.1407+4.6431i |
| m5 | 0.9600 | 38.9598 | 0.0232 | 1.0363+0.0302i |

| Name | Freq | Ang | Mag | RX |
|---|---|---|---|---|
| m1 | 2.2036 | -8.0810 | 0.9266 | 5.9446-10.9506i |
| m2 | 1.6951 | 64.1446 | 0.9586 | 0.0749+1.5933i |
| m3 | 2.6044 | -77.4234 | 0.9253 | 0.0989-1.2429i |
| m4 | 0.6000 | 147.4249 | 0.9893 | 0.0058+0.2922i |

| Curve info |
|---|
| S(1,1) Setup1: Sweep |
| S(2,1) Setup1: Sweep |
| S(3,3) Setup1: Sweep |

| Name | Freq | Ang | Mag | RX |
|---|---|---|---|---|
| m1 | 3.6500 | -174.1655 | 0.9746 | 0.0129-0.0510i |
| m2 | 3.6500 | -133.9445 | 0.1712 | 0.7661-0.1946i |
| m3 | 3.6500 | -46.2894 | 0.9741 | 0.0847-2.3368i |
| m4 | 2.2000 | -89.6705 | 0.9916 | 0.0085-1.0057i |
| m5 | 0.8600 | -31.9089 | 0.9981 | 0.0129-3.4979i |

| Curve info |
|---|
| St(p1,p1) Setup1: Sweep1 |
| St(p2,p2) Setup1: Sweep1 |

| Name | Freq | Ang | Mag | RX |
|---|---|---|---|---|
| m1 | 0.6890 | -41.2351 | 0.2555 | 1.3726-0.4947i |
| m2 | 0.9620 | -153.3134 | 0.2707 | 0.5952-0.1562i |
| m3 | 0.8255 | 60.1065 | 0.2892 | 1.1521+0.6303i |

| Curve info |
|---|
| St(p1,p1) Setup1: Sweep1 |
| St(p2,p2) Setup1: Sweep1 |

| Name | Freq | Ang | Mag | RX |
|---|---|---|---|---|
| m4 | 1.6885 | -77.4304 | 0.3128 | 0.9381-0.6349i |
| m5 | 2.6765 | 168.8610 | 0.3089 | 0.5316+0.0701i |
| m6 | 2.2020 | 16.0536 | 0.2715 | 1.6785+0.2722i |

| Curve info |
|---|
| St(1,1) Setup1: Sweep1 |
| St(2,1) Setup1: Sweep1 |

| Name | Freq | Ang | Mag | RX |
|---|---|---|---|---|
| m1 | 3.1082 | 157.0121 | 0.3278 | 0.5216+0.1497i |
| m2 | 3.1082 | 101.8877 | 0.2982 | 0.7518+0.4816i |
| m3 | 4.2000 | 1.5941 | 0.3259 | 1.9660+0.0399i |
| m4 | 4.2000 | -19.7038 | 0.3395 | 1.8588-0.4811i |

MULTIBAND ANTENNA WITH DIPOLE RESONANT STRUCTURES

FIELD OF THE INVENTION

This invention relates to dipole antennas. More particularly, this invention relates to dipole antennas with interspersed resonant circuits.

DESCRIPTION OF RELATED ART

With the ever-increasing need for more compact base station antennas, prior art designs include antennas with multiple arrays of elements, operating on separate frequency bands. These elements from different bands may be close to one another and in a single enclosure and co-located on a single conductive reflector. In some cases, the elements of the different arrays can be located on separate reflectors but they are still very close to one another.

In such arrangements, the lower frequency antenna elements which are larger in size, can reside around and above the higher frequency, smaller antenna elements, all in proximity to one another. One issue with such dense collections of arrays at different bands is degraded performance due to parasitic effects of the arrays on the signals emanating from each other, interacting across frequency bands. For example, low frequency elements can have a parasitic effect on the higher frequency elements, and vice-versa. Antenna elements of a first array of elements that operate at one frequency band can appear "electrically large", for example greater than a half wavelength (Lambda at frequency F is (3*10e6)/(F [Hz]) (meters), at the frequencies of the nearby antenna elements of the other arrays.

To reduce this parasitic effect the prior art focuses on essentially two options. The first option is to increase the spacing of the different frequency arrays from one another on the reflector, but this undesirably increases the footprint of the antenna. Another option is to simply operate with the parasitic effects from the interspersed arrays, but this results in less than ideal coverage area for the antenna, including lobes and drop-off zones or "null zones."

There have also been prior art attempts to dampen this parasitic effect by placing "chokes" on the arms of the dipole. A choke is a physical structure on the dipoles that blocks high frequency signals while passing low frequency signals. See for example, U.S. Pat. No. 9,912,076 which includes an array of high frequency elements and an array of low frequency elements on the same reflector. The larger arms of the low frequency dipoles can include RF chokes that provide an open circuit or a high impedance in response to high frequency signals, separating adjacent dipole conductive segments to minimize induced high band currents in the low-band radiator and consequent disturbance to the nearby high band radiating pattern. These RF chokes is resonant at or near the frequencies of the high band.

However as illustrated in the prior art FIGS. 1 and 2 from the '076 patent the RF choke resonant structures are in the form of boxes along the arm of the low frequency dipole. This particular implementation of RF filter is relatively large, compared to the elements themselves, due to the lower dielectric constant of air. It also requires high mechanical metalwork accuracy and expertise.

OBJECTS AND SUMMARY

The present invention overcomes the drawbacks associated with the prior art and provides novel resonant structures that are included in the printed circuit board (PCB) within the arms of dipoles. Moreover, unlike the prior art, the novel PCB resonant structures are of such a design that they may be included within the vertical balun feeds of the dipoles as well. In each case, such resonant structures reduce the parasitic effects of nearby antenna elements of different frequency arrays on the same or nearby reflectors.

These resonant structures are placed not only on the arms of the low frequency dipoles but also on the nearby high frequency elements as well. These resonant structures are included not only on the horizontal arms but also on the vertical balun feeds extending perpendicular from the reflector. In some arrangements the resonant structures are in the form of either parallel resonant circuits or series resonant circuits (high pass configuration).

To this end the present arrangement provides for an antenna for cellular communications having a reflector and at least a first array of dipole antenna elements on the reflector operating at a first frequency ban. The dipole antenna elements of the first array having a printed circuit construction and composed of a balun feed and dipole arms. At least a second array of dipole antenna elements is provided on the reflector operating at a second frequency band the dipole antenna elements of the first array having a printed circuit construction and composed of a balun feed and dipole arms.

The dipole antenna elements of the first array include one or more resonant structures causing a substantially closed circuit at the first frequency band and a substantially open circuit at the second frequency band. The resonant structures on the dipole antenna elements of the first array are located at least in part on the balun feed of the dipole antenna elements.

In another embodiment an antenna for cellular communications has a reflector and at least a first array of antenna elements on the reflector operating at a first frequency band, the dipole antenna elements of the first array having a printed circuit construction and composed of a balun feed and dipole arms. At least a second array of antenna elements is provided on the reflector operating at a second frequency band, the dipole antenna elements of the second array having a printed circuit construction and composed of a balun feed and dipole arms.

The printed circuit construction of the antenna elements of the first array include one or more printed circuit resonant structures causing a substantially closed circuit at the first frequency band and a substantially open circuit at the second frequency band.

BRIEF DESCRIPTION OF THE DRAWINGS

The present invention can be best understood through the following description and accompanying drawing, wherein.

DETAILED DESCRIPTION

Figure 1:
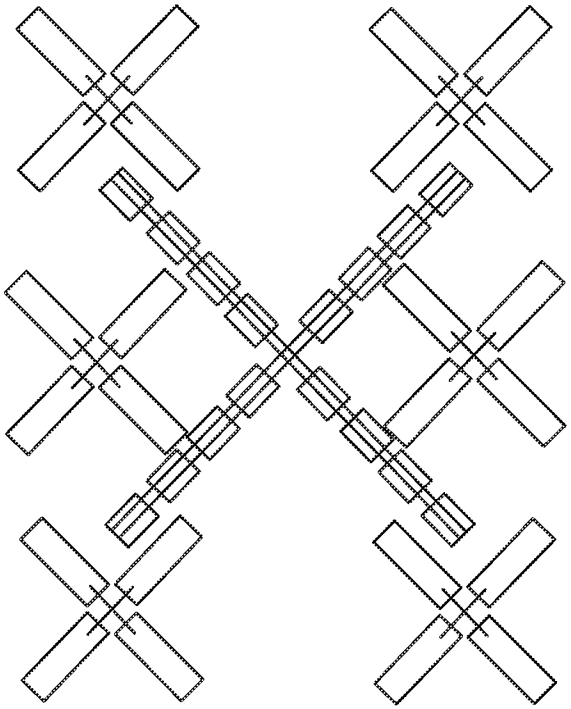
FIG. 1 (Prior art)
FIG. 1 is a prior art image of multiple frequency arrays on a reflector with resonant structures.
Figure 2:
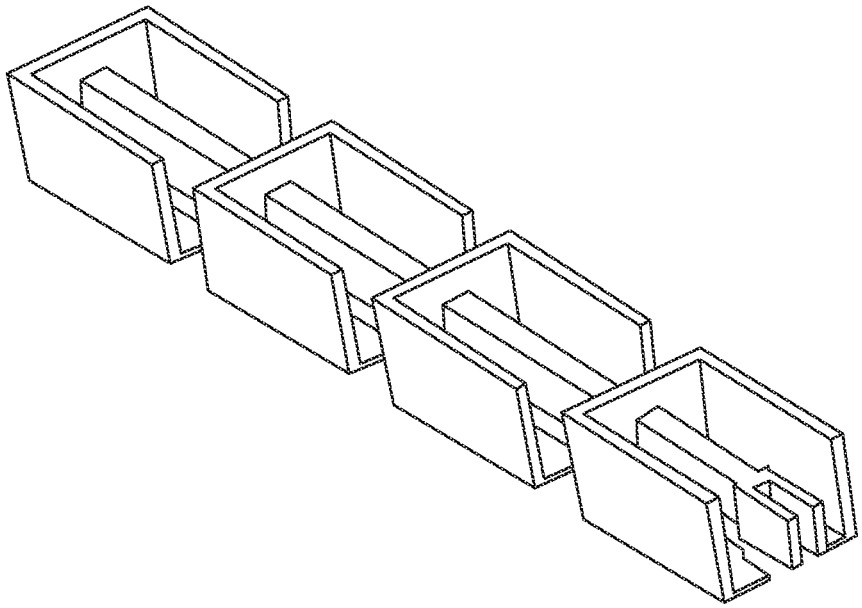
FIG. 2 (Prior art)
FIG. 2 is a prior art image of a dipole arm with resonant structures.
Figure 3:
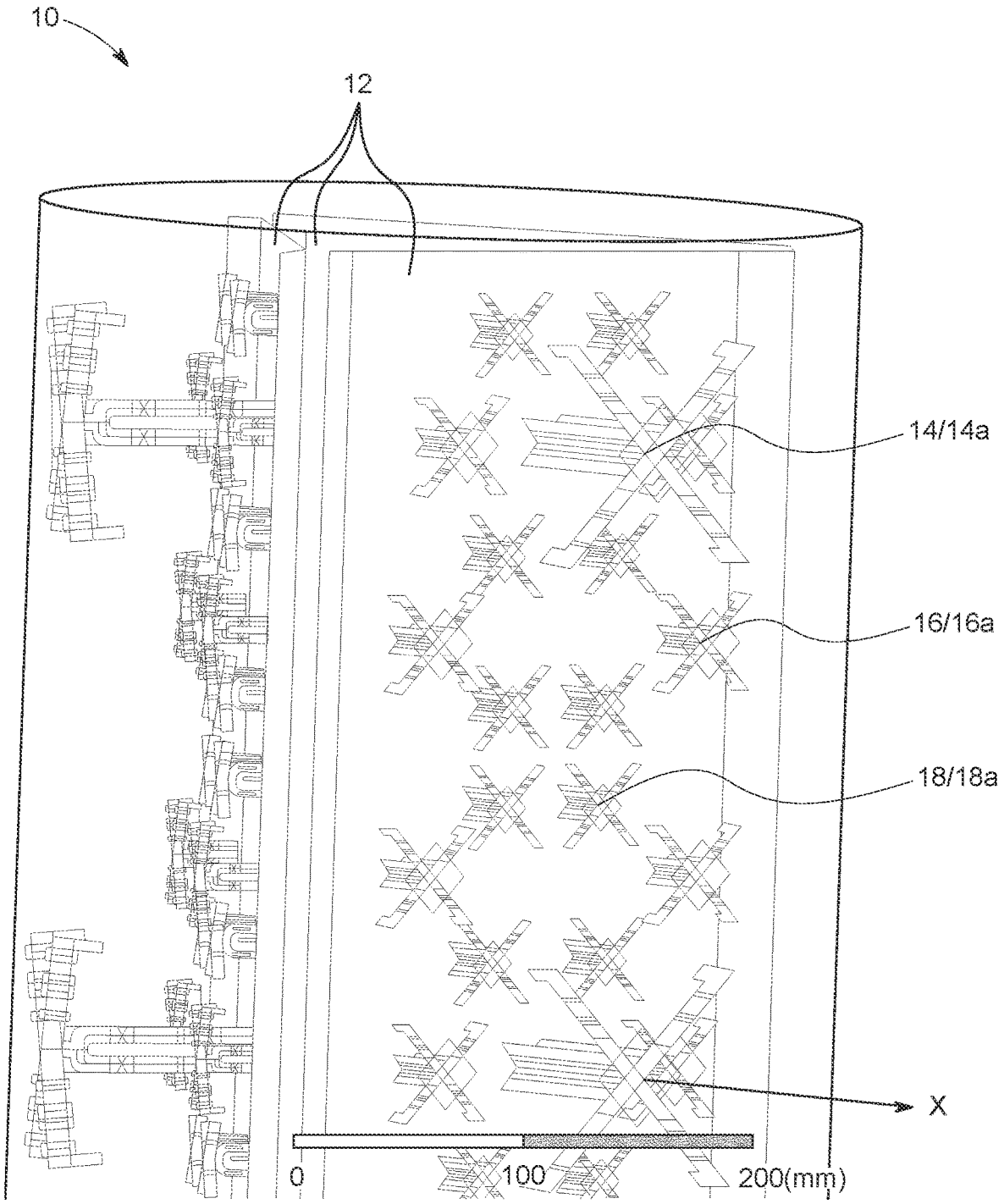
FIG. 3 illustrates an antenna with multiple frequency arrays in accordance with one embodiment.
Figure 4:
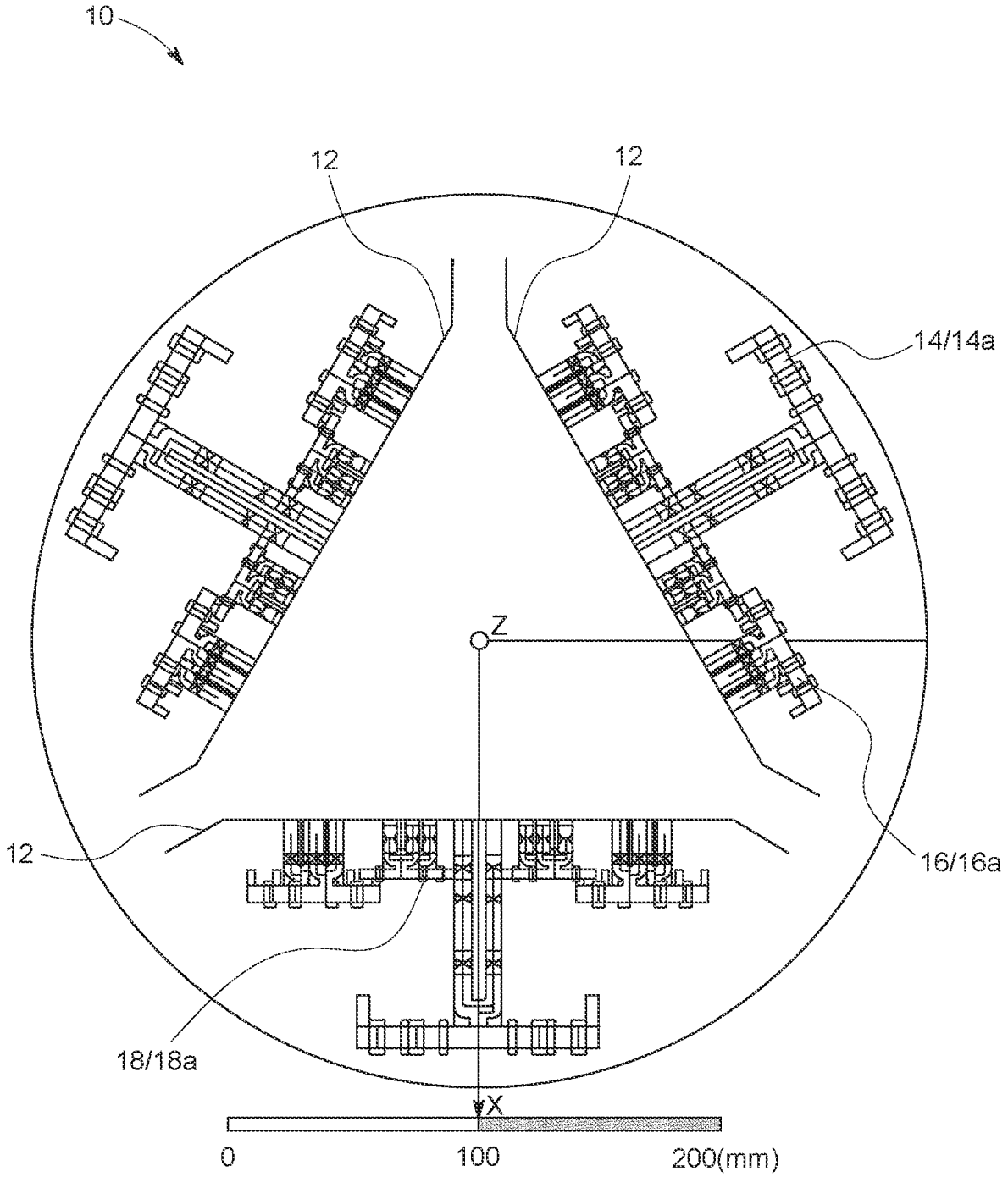
FIG. 4 illustrates an antenna with multiple frequency arrays in accordance with one embodiment.

In one embodiment of the present invention as illustrated in FIGS. 3 and 4, a multi frequency band antenna 10 is shown. In this example, antenna 10 is a three panel omni directional antenna, but the invention is not limited in this respect. The salient features described below can be used in conjunction with any antenna that has two or more different frequency arrays on a single reflector or nearby reflector. In the example of FIGS. 3 and 4, antenna 10 has three reflector panels 12, each of which has three different frequency arrays, a low frequency array of elements 14, a mid frequency array of elements 16, and a high frequency array of elements 18. As shown in the top elevation FIG. 4 as well as FIG. 3, each of arrays, 14, 16, and 18 include multiple dipole elements 14*a*, 16*a*, and 18*a* respectively, each part of their own respective frequency array.

Figure 5:
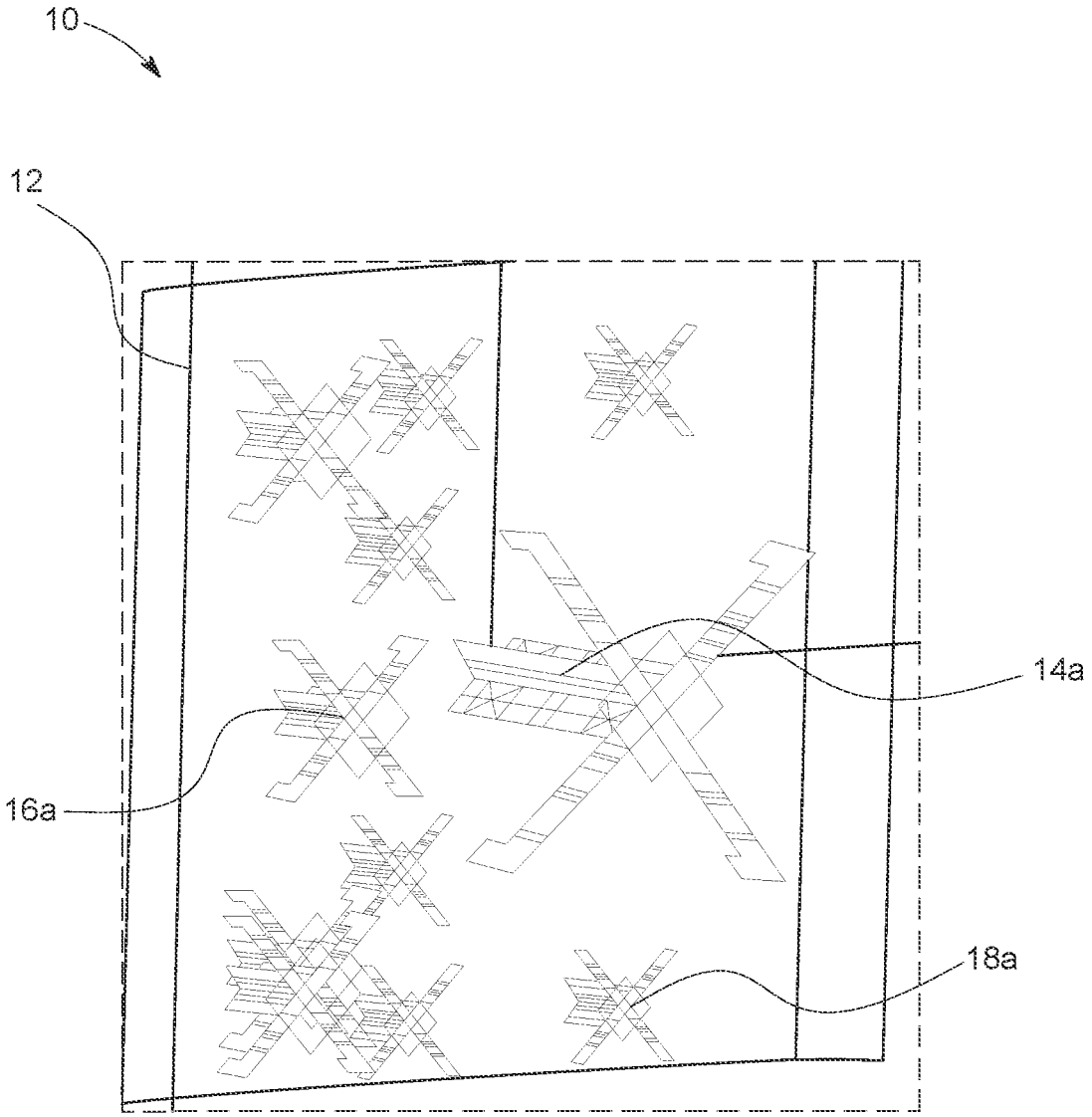
FIG. 5 illustrates a portion of a reflector with dipole elements from different frequency arrays in accordance with one embodiment.

FIG. 5 shows another partial representation of an exemplary panel 12 to show an arrangement of dipole elements 14*a*, 16*a*, and 18*a* forming the three frequency arrays. As illustrated in this figure, the various elements are closely interspersed in physical proximity to each other. As explained above, the larger low frequency elements have a parasitic effect on the higher frequency elements and vise versa.

Figure 6:
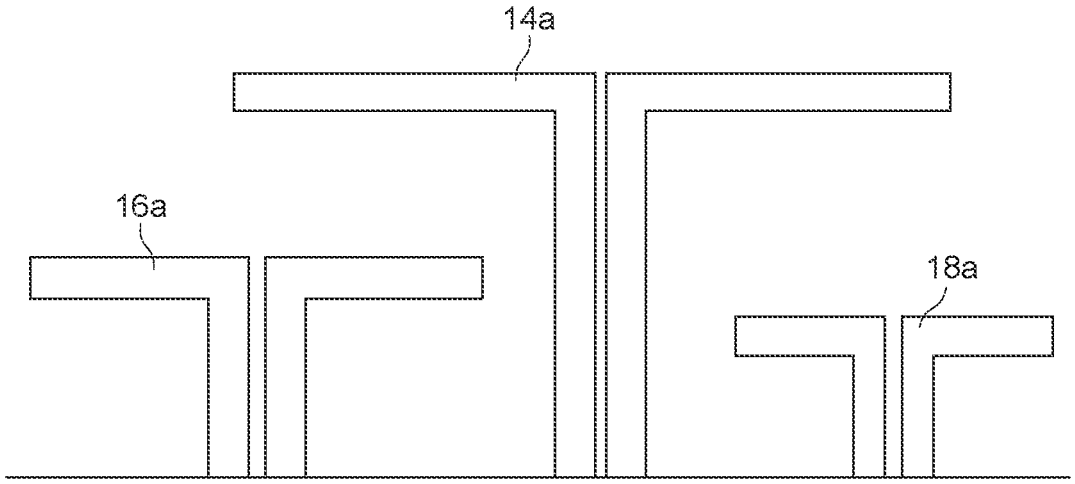
FIG. 6 illustrates three dipole antenna elements from different frequency arrays on a single reflector in accordance with one embodiment.

FIG. 6 is an exemplary schematic view of one segment of panel 12, with one low frequency element 14*a*, one mid frequency element 16*a*, and one high frequency element 18*a*. FIG. 6 shows one elements 14*a*, 16*a*, and 18*a*, without the inventive resonant structures for the purposes of giving an exemplary spatial context to the elements on reflector panel 12, and also to provide base structures on which to build on to explain the salient features of the resonant structures.

In this example low frequency element 14*a* is a 0.86 Ghz band element, mid frequency element 16*a* is a 2.2 GHz band element, and high frequency element 18*a* is a 3.6 GHz band element. As seen in this schematic, three exemplary elements 14*a*, 16*a*, and 18*a* are shown with overlapping or nearly overlapping footprints which, as explained in the background, would result in parasitic effects by one element on the adjacent two. For the purposes of illustration these three frequency bands are used, however the structures described herein can be modified to be used for other frequency bands.

Figure 7:
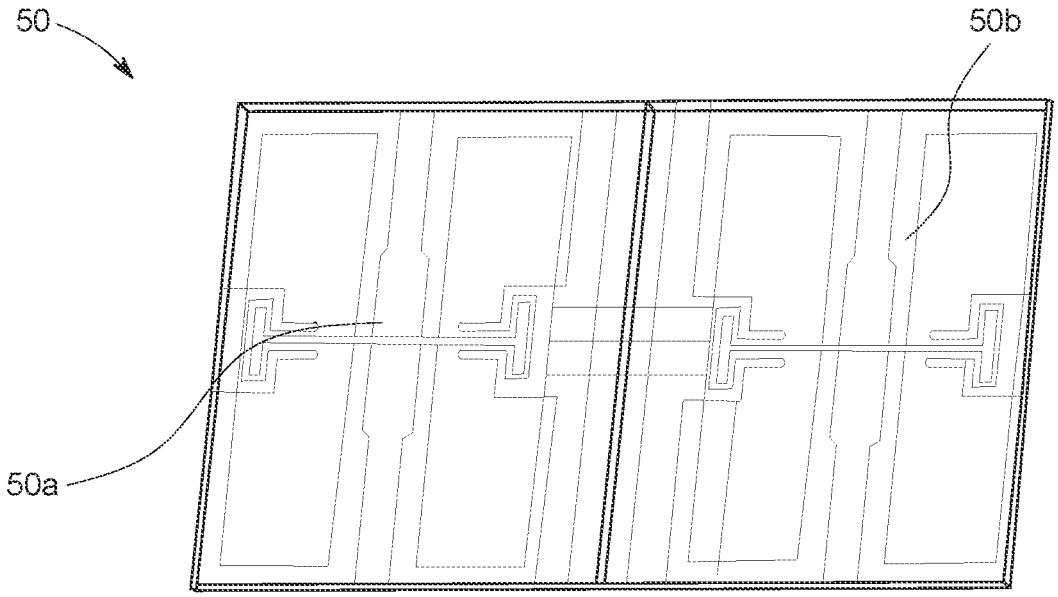
FIG. 7 illustrates components of a PCB resonant structure for a dipole element in accordance with one embodiment.

As shown in the FIG. 7 an exemplary resonant structure 50 in the form of a Parallel LC structure (high impedance), is sized for acting as an open circuit at 2.2 GHZ (mid band) or sized as an open circuit at 3.6 GHZ (high band). For the purposes of illustration, parallel resonant structure 50 shown in FIG. 7 and described in more detail below is for the 2.2 Ghz open circuit resonance in the balun feed of low band dipole 14*a* (resonant structure 51 described below is for the 3.6 Ghz open circuit resonance in the balun feed of low band dipole 14*a*). The balun feed involves a vertical signal feed in two parallel columns running vertically to the dipole arms. Resonant structure 50 has two halves 50*a* and 50*b* one structure for each of balun feed columns. As will be described more fully in connection with another embodiment of the invention, a resonant structure for the balun feed of 14*a* is sized for acting as an open circuit at the high band 3.6 Ghz.

Figure 8:
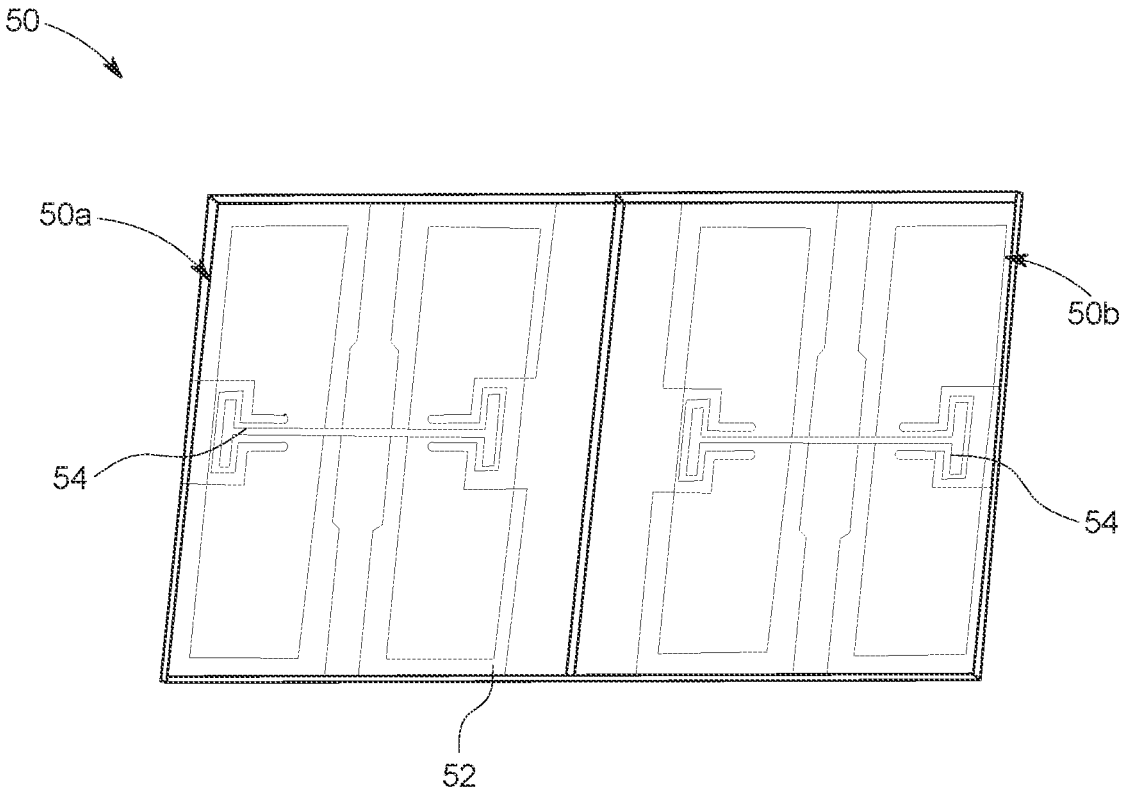
FIG. 8 illustrates a vertical ground copper layer in a parallel PCB resonant structure for a dipole element in accordance with one embodiment.
Figure 9:
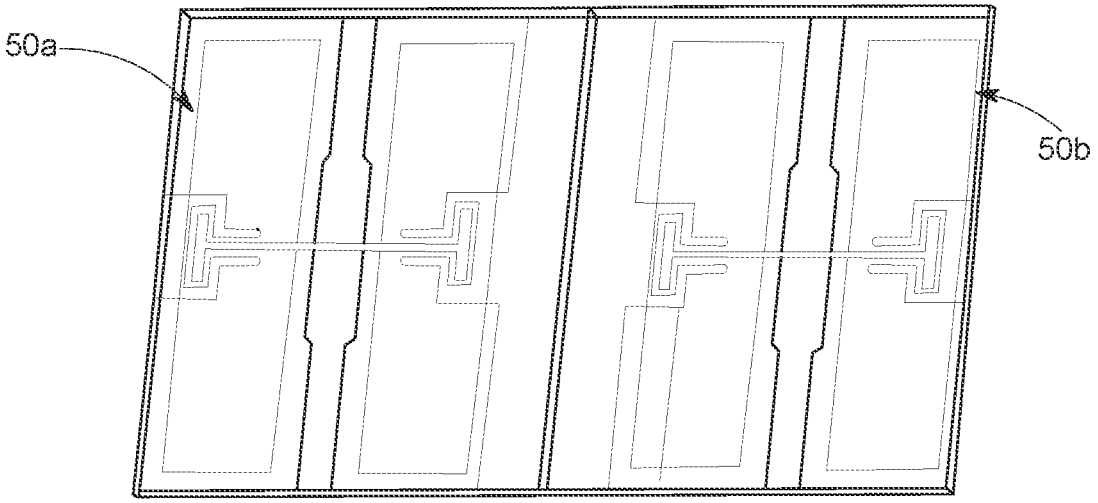
FIG. 9 illustrates a microstrip transmission line in a parallel PCB resonant structure for a dipole element in accordance with one embodiment.
Figure 10:
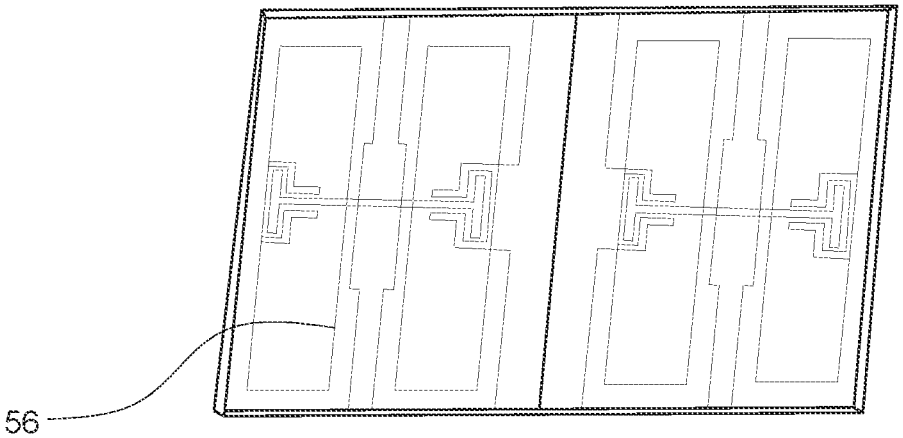
FIG. 10 illustrates an insulating substrate of a parallel PCB resonant structure for a dipole element in accordance with one embodiment.
Figure 11:
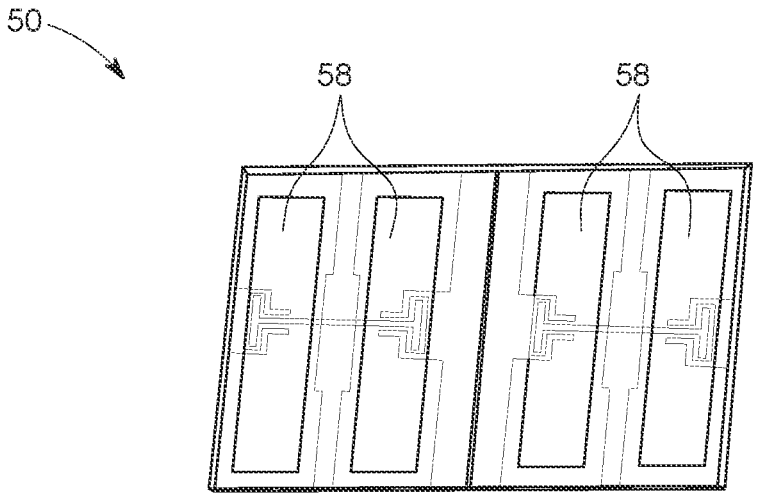
FIG. 11 illustrates a capacitive copper layer of a parallel PCB resonant structure for a dipole element in accordance with one embodiment.

FIGS. 8 through 11 show the iterations and layers to form resonant structure 50. FIG. 8 represents a vertical balun ground plane 52 forming the ground plane gap and an inductive connection 54. Inductive connection is a narrow copper line 54 that transverses the vertical balun ground gap. There are two such copper lines 54 on both sides of resonant structure 50*a*/50*b*, symmetrically located around a ground center point, and connecting the upper ground and the lower ground. FIG. 9 shows the next layer which is essentially just the microstrip transmission line of the vertical balun feed of the dipole. FIG. 10 shows a vertical balun feed PCB substrate 56 substrate (e.g. 0.5 mm thick). FIG. 11 illustrates a vertical balun feed resonant capacitance top plate 58 (for bridging ground plane gap).

Figure 12:
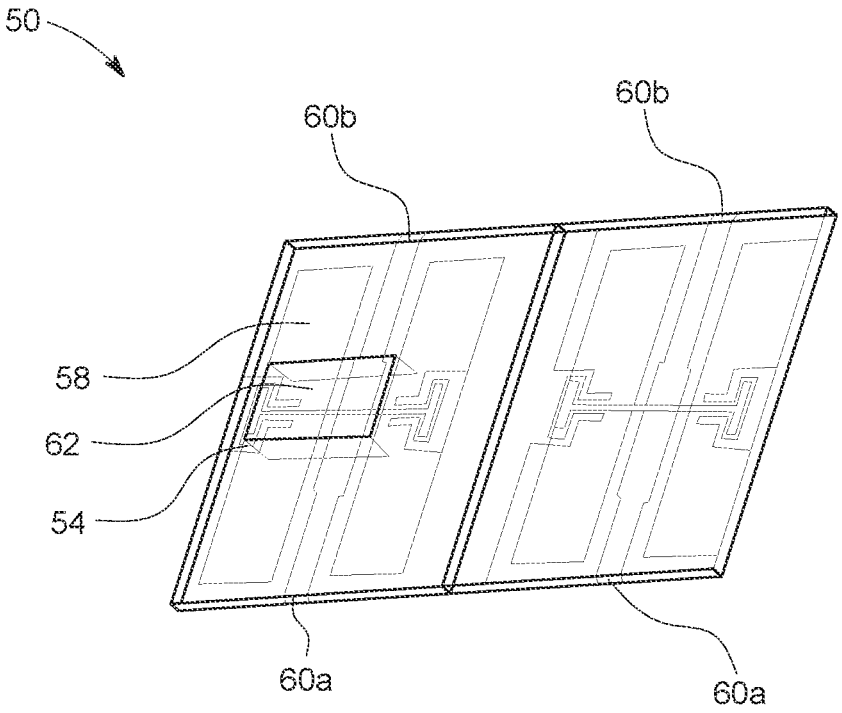
FIG. 12 illustrates a port placement on a parallel PCB resonant structure for a dipole element in accordance with one embodiment.

FIG. 12 shows the resonant structure above from FIGS. 7 through 11, with added explanations for the resonant circuit ports. Transmission line ports 60*a* (bottom) and 60*b* (top) are just the entry and exit ports for the balun feed circuit itself. Port 62 illustrates the open circuit resonance port that lies across the ground plane gap. The resonant frequency is determined as follows:

$$Fres=1/(2*\pi*(sqrt(L*C)))[Hz]$$

For example, in an exemplary calculation for parallel resonance at 2.2 GHz, the following values can be used:

$$L=3\ nH$$

$$C=1/(((Fres*2*\pi)\hat{}2)*L)=1.74\ [pF]$$

where, the inductance is a narrow copper trace of approximately 3 mm in length, and the parallel plate capacitance is calculated from the formula:

$$C=\epsilon r*\epsilon o*A/D[F]$$

Where:

$\epsilon r$=relative permittivity of dielectric $\epsilon o$=8.854*10^(−12) [F/m] (permittivity of free space)

A=capacitor area [m^2]

D=dielectric thickness [m]

Note that in the implementation shown in FIGS. 7 to 12, there are 2 parallel inductances and 2 series capacitances, the values referenced above are the total resultant inductance and capacitance (L and C).

In the case of the parallel resonance at 3.6 GHz, the following values can be used:

$$L=3\ nH$$

$$C=1/(((Fres*2*\pi)\hat{}2)*L)=0.65\ [pF]$$

Note also that the transmission line has the effect of adding capacitance in parallel with the parallel L-C network, so it adds to the total resultant capacitance. The final configuration may be simulated with a CAD tool to take into account all effects of the circuit, and optimized for proper performance.

Figure 13:
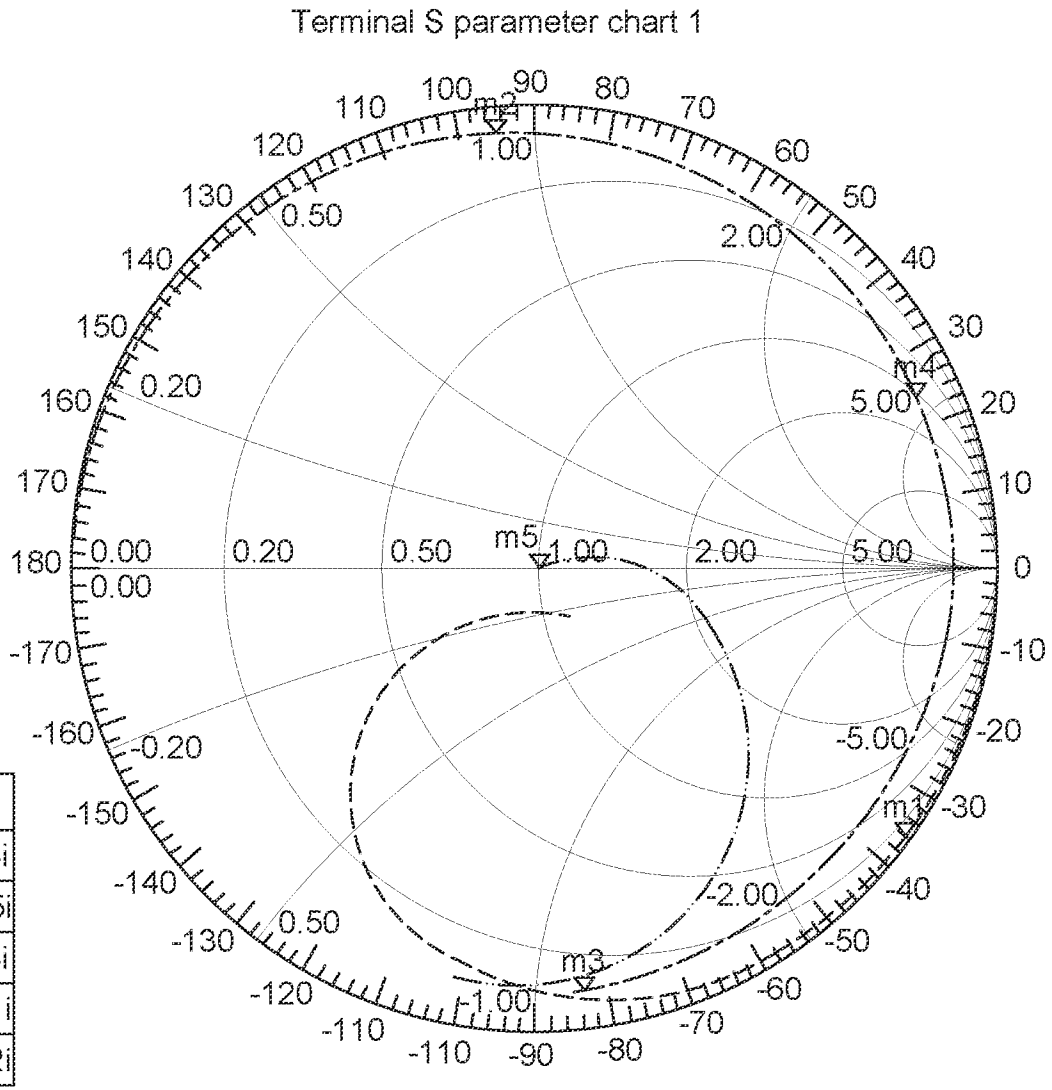
FIG. 13 is a smith diagram for a PCB resonant structure for a dipole element in accordance with one embodiment.

FIG. 13 shows a smith diagram of the frequency response for resonant structure 50 as it would be applied on the balun feed of dipole 14*a* showing a closed circuit at approximately 0.86 Ghz but "open" at the approximate mid band frequency of 2.2 Ghz. It is noted that that by "open" in this context and as used throughout regarding the resonant structures through the application is "open" or "near to an open" below resonance, at least enough to reduce induced parasitic currents and coupling to the lower frequency adjacent elements. For example, marker 5 (M5) shows a port impedances close to 50 Ohms of 1.00 and marker 1 (M1) shows low transmission loss along the transmission line (e.g. from port 60*a* to 60*b* from FIG. 12). However, the open circuit resonance (e.g. at port 62 from FIG. 12) is open at markers 3, 4, and 5 (M3, M4, and M5). As noted above, the present example is for a resonant structure 50 for the balun feed of dipole 14*a*, where is it sized and dimensioned to provide an open circuit at 2.2 Ghz, but the same concepts hold true for a differently dimensioned resonant structure 50 for 3.6 Ghz that could also be placed on the balun feed of element 14*a* and would result in a similar smith diagram showing a closed circuit at approximately 0.86 Ghz and open circuit at 3.6 Ghz. For example, altering the resonant frequency can be achieved by reducing the, an L or C or both L and C portions of copper line 54 to open circuit resonate at the higher frequency of 3.6 Ghz using the equation above.

For example, in FIG. 13, the plotted line at (s(3,3)) on the smith chart passes near the upper part of the graph at marker m2 (1.7 GHz, which is the low end of the mid frequency band), then goes near to an open circuit (the middle right hand side of the graph) near marker m4 (2.2 GHz) which is the middle of the mid frequency band), and then, the frequency increases by marker m3 (2.7 GHz, which is the high end of the mid frequency band). This line actually travels clockwise around the outer edge of this smith chart, even starting out near the middle left hand side of the chart, which is near a short circuit (that is at the low frequency band). However, if the line for resonant structure 50 were to be swept to even high frequency, the line would continue in a clockwise direction, past marker m3, and actually head towards a short circuit again (e.g. at the middle left hand side of the chart). This may occur near the high frequency band. As such, the balun feed of low frequency elements 14*a* include not only resonant structures 50 to be open at the mid band frequency of 2.2 Ghz, but also separate resonant structures 51 to be open at the high band frequency of 3.6 Ghz.

Figure 14:
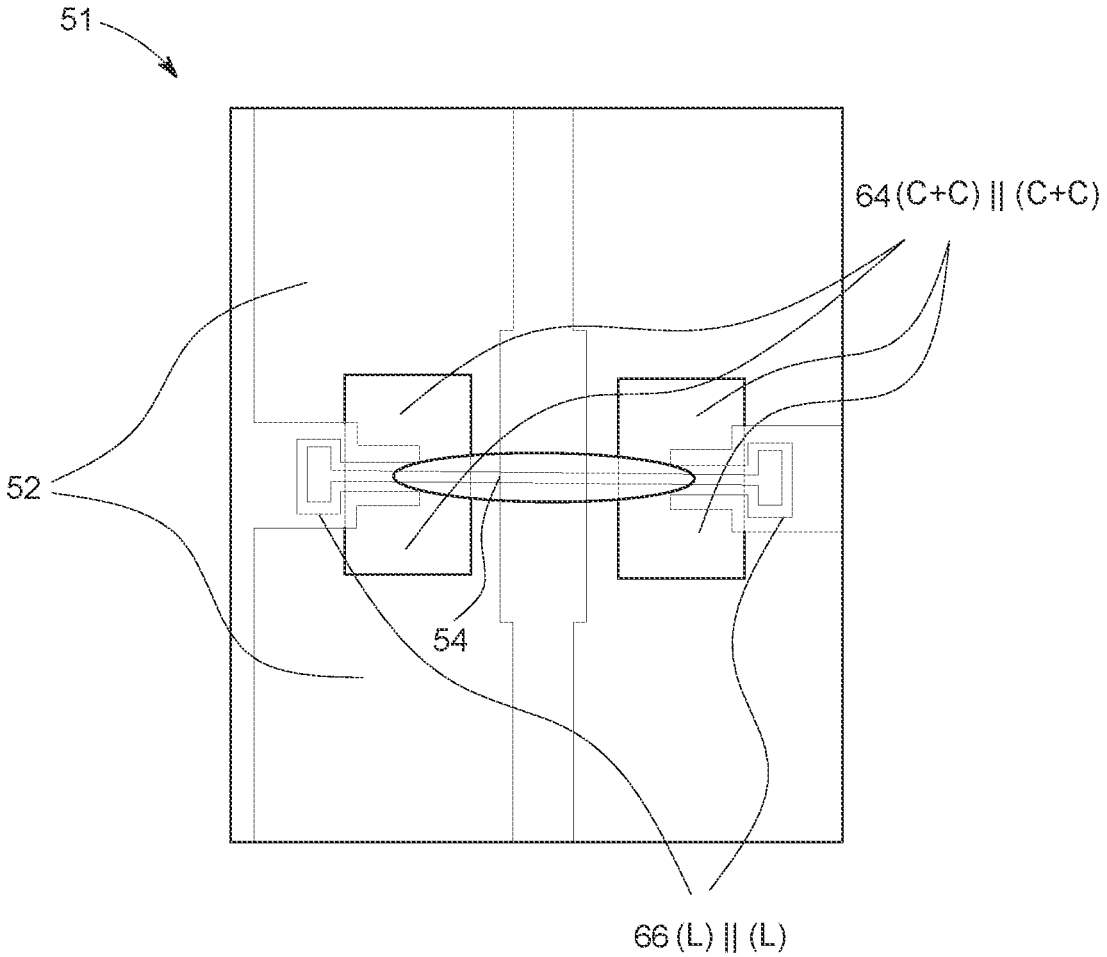
FIG. 14 illustrates a PCB resonant structure for a dipole element in accordance with one embodiment.

For example, FIG. 14 shows resonant structure 51 and how the LC structure generates the closed circuit at the low band (in this example) and the open circuit at high band (using the same sub-structures as labeled in FIG. 12 and with structure 50). As shown in FIG. 14 The (C+C)||(C+C) (see location 64) creates a capacitance Cr. The L||L (see location 66) creates a resultant inductance Lr. Lr is in parallel with Cr and resonates to an open circuit and Lr is small enough to not perturb the microstrip feed impedance across port 60*a* and 60*b*.

In the case of the low band element 14*a*, each vertical balun feed open circuit parallel resonant circuit at port 62 is tuned to provide, in the vertical direction, an open circuit balun ground at either high band 3.6 Ghz (structure 51/FIG. 14) or mid band 2.2 Ghz (structure 50/FIG. 12) and closed at low band of 0.86 Ghz with a well matched (i.e. 50 Ohms) on the microstrip balun feed ports 60*a* and 60*b*.

The above description of resonant structure 50 (mid band open) for use on the balun feed of low band dipole 14*a* is essentially the same for resonant structure 51 (high band open) shown in FIG. 14. Regarding the resonant structures to be used on the arms of the diploes, such as low band dipole 14*a*, work on essentially the same principle as resonant structures 50/51.

Figure 15:
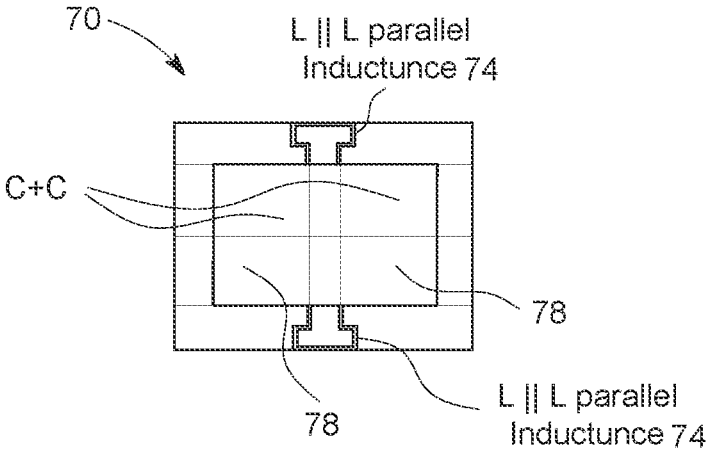
FIG. 15 illustrates a PCB resonant structure for a dipole arm of a dipole element in accordance with one embodiment.

FIG. 15 shows an exemplary resonant structure 70 for mid band open circuit to be used on the arms of low band dipole 14*a*. (Resonant structure 71 will be used to refer to the resonant structure or high band open circuit to be used on the arms of low band dipole 14*a*).

Figure 16:
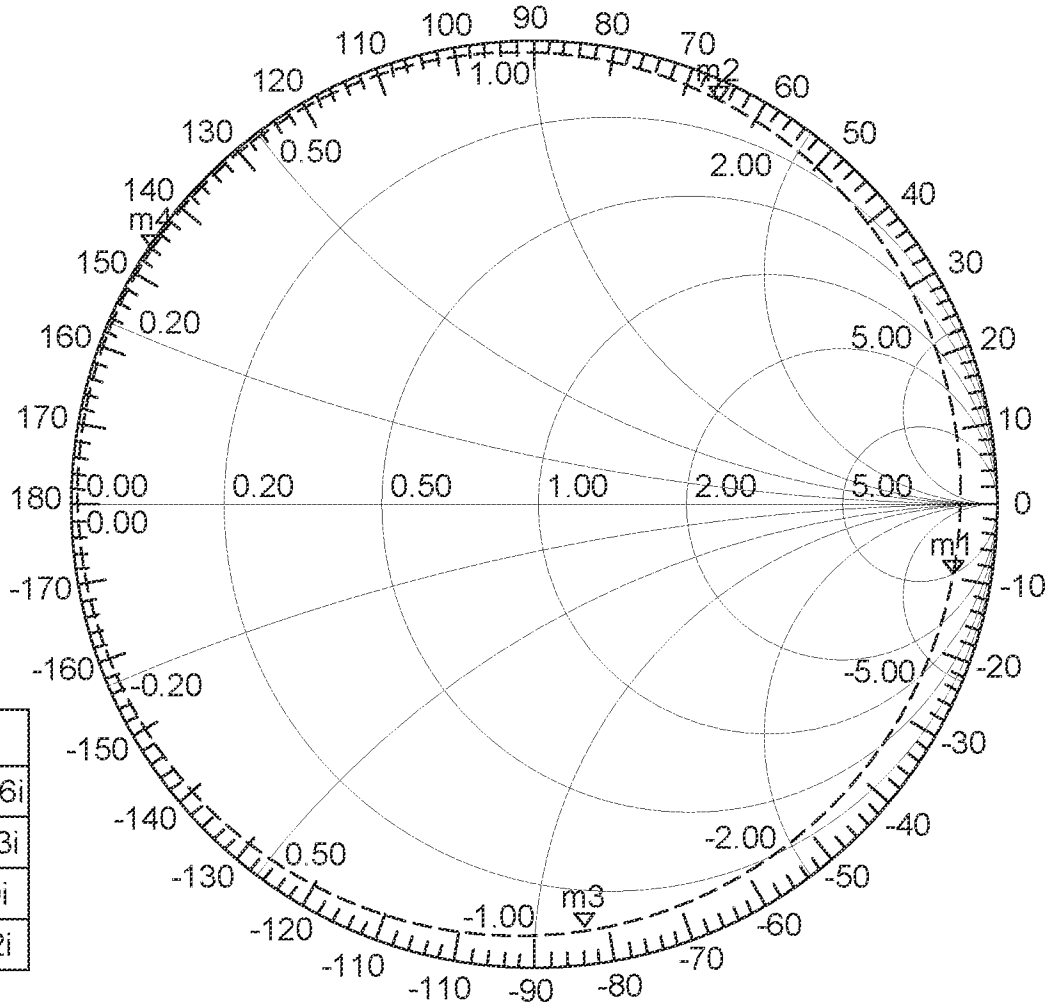
FIG. 16 is a smith diagram for a PCB resonant structure for a dipole element in accordance with one embodiment.

As with resonant structure 50, resonant structure 70 provides low impedance at low band 0.86 Ghz and an open circuit at either mid band (2.2 Ghz—structure 70) or high band (3.6 Ghz—structure 71—not shown) depending on the dimensions and arrangement of the L and C elements. Such resonant structure 70 likewise has a copper wire 74 (forming L component—inductance) and capacitance plate 78 (forming C component). The impedance is defined along the diploe arm of element 14*a*. The L||L inductance and the C+C capacitance create a parallel L-C network, same as in the resonant structure 50. As shown in the related smith diagram of FIG. 16 marker M1 shows an open circuit at the mid band frequency of about 2.2 Ghz with a closed circuit across the dipole arm of element 14*a* at near the low band frequency of 0.86 Ghz.

The above examples of resonant structure 50/51 for the balun feed of low band elements 14*a* and resonant structures 70/71 for the diploe arm of low band elements 14*a* can be likewise used on mid band element 16*a* as resonant structure 80 for the balun feed (3.6 Ghz open—closed at 2.2 Ghz) and resonant structure 81 for the dipole arm of element 16*a* (also 3.6 Ghz open—closed at 2.2 Ghz). Element 16*a* does not need to have a resonant structure at 0.86 Ghz low band because of limited space on the mid-band element and also the parasitic effect of the mid-band element 16*a* on the low band element 14*a* is somewhat less. However, it is noted that the series resonant circuit analogous to the one used on the high band element (described below) could also be used on the mid-band element if significant degradation of the low band element is seen in the presence of the mid-band element. This would create a mid band element with parallel resonant circuits resonating at high band as well as series resonant circuits resonating at mid-band.

Figure 17:
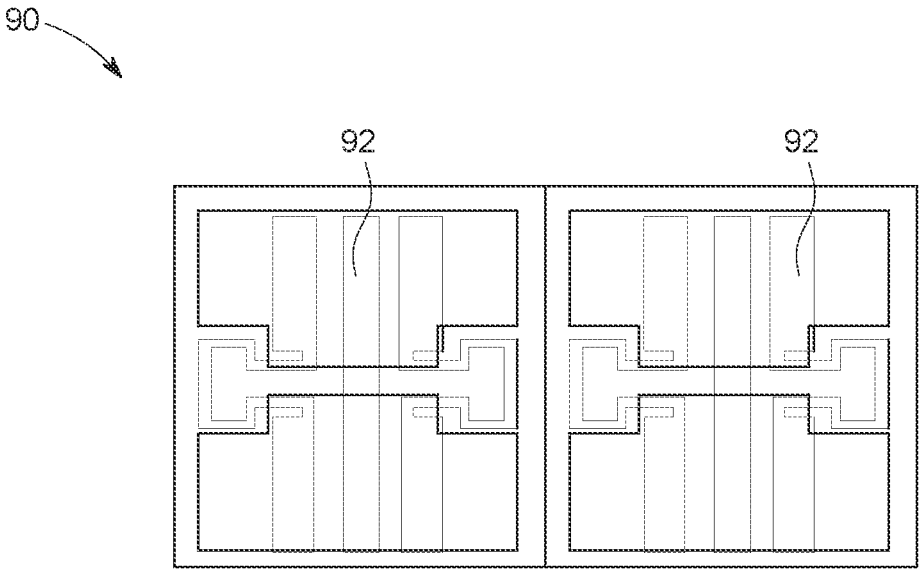
FIG. 17 illustrates components of a PCB resonant structure for a balun feed of a dipole element in accordance with one embodiment.
Figure 18:
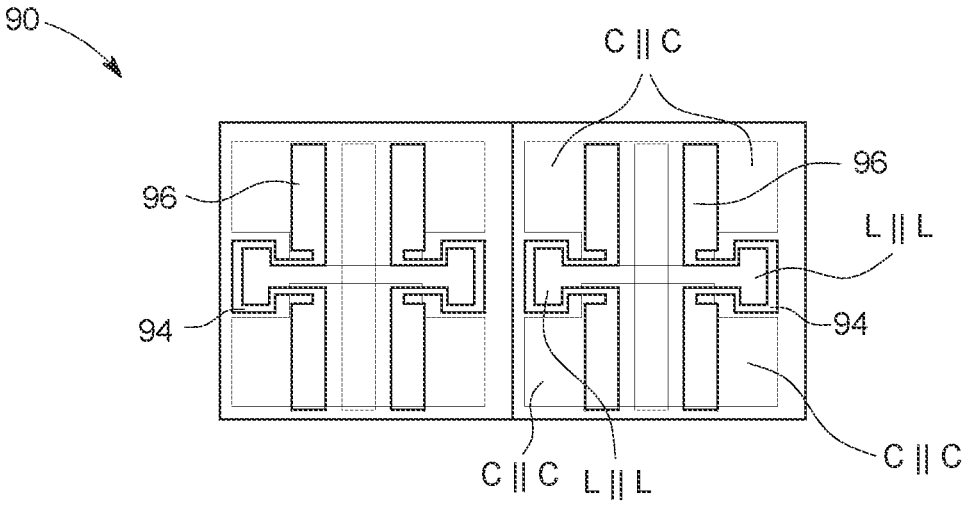
FIG. 18 illustrates components of a PCB resonant structure for a balun feed of a dipole element in accordance with one embodiment.
Figure 19:
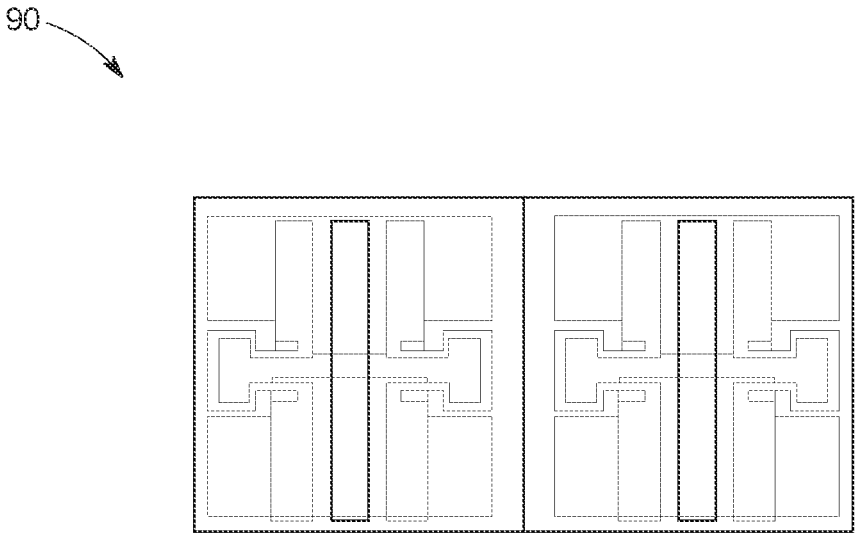
FIG. 19 illustrates components of a PCB resonant structure for a balun feed of a dipole element in accordance with one embodiment.
Figure 20:
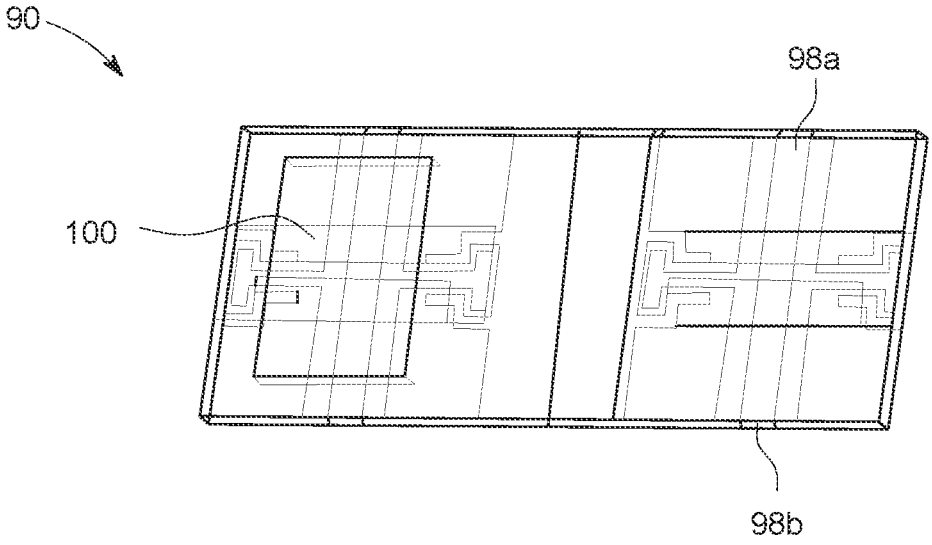
FIG. 20 illustrates components of a PCB resonant structure for a balun feed of a dipole element in accordance with one embodiment.

Regarding the resonant structure on the high band elements 18*a*, these are series resonant structures instead of parallel resonant structures as used on elements 14*a* and 16*a*. Such series resonant structures on the high band elements 18*a* are essentially high pass filters to prevent the high frequency elements from interfering with the signals from the low and mid band structures. For example, FIGS. 17-19 show the layered structure of a series resonant structure 90 for use on high band element 18*a* that is closed at 3.6 Ghz but having high impedance at the lower 0.86 Ghz and 2.2 Ghz. FIG. 17 illustrates a vertical balun ground plane including 92. FIG. 18 shows the layer of the vertical balun feed resonant series (C-L-C shape) with a capacitor top plate 96 and thin copper line inductor 94, which are not connected to ground plane. FIG. 19 shows the balun feed transmission line. FIG. 20 illustrates resonant structure 90 with ports 98*a* and 98*b* for the balun feed transmission line and port 100 for resonant structure 90. As with the resonant structures 50, 70, and 80 for balun feeds of elements 14*a* and 16*a*, resonant structure 90 may likewise be modified (resonant structure 91) to be on the arms of elements 18*a*.

Figure 21:
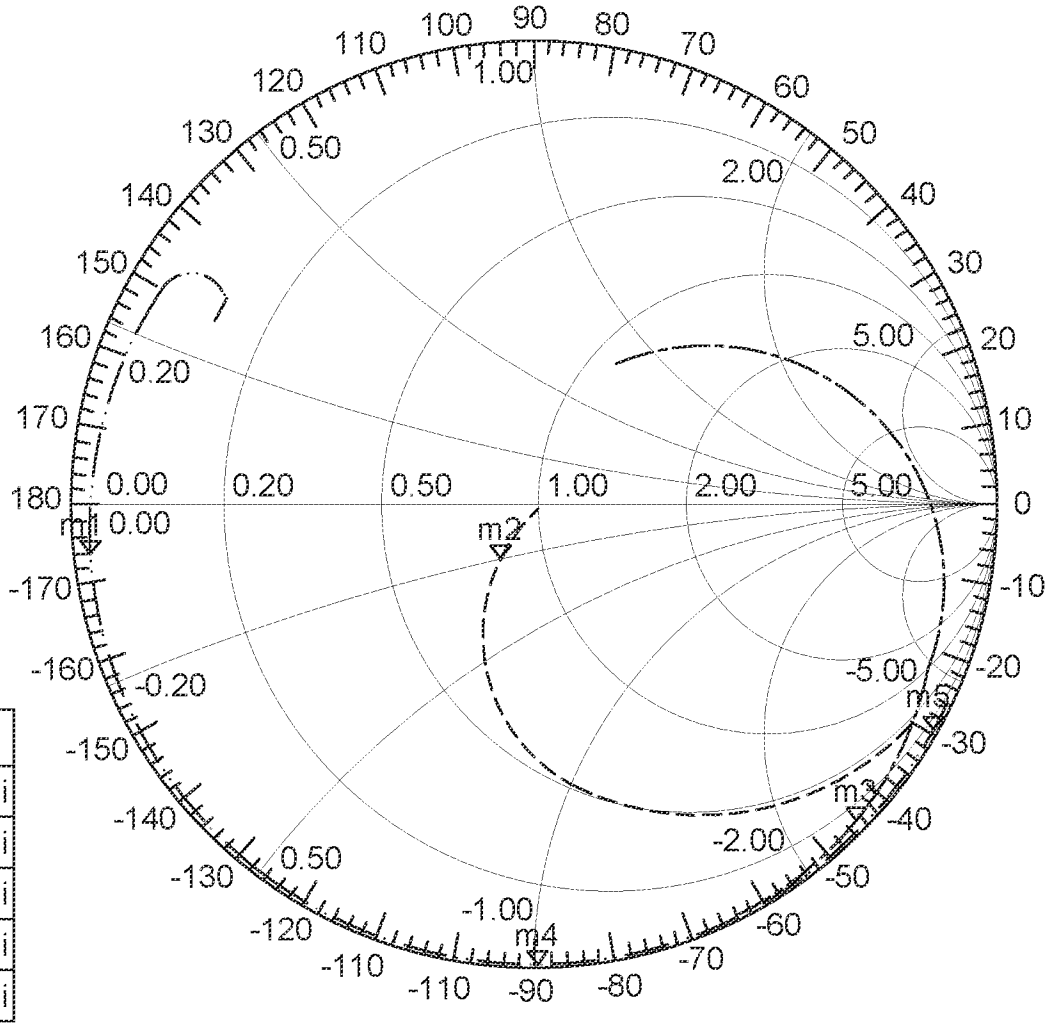
FIG. 21 is a smith diagram for a PCB resonant structure for a dipole element in accordance with one embodiment.

FIG. 21 shows smith diagram for resonant structure 90 that provides low impedance at high frequency 3.6 Ghz and high impedance at 0.86 Ghz and 2.2 Ghz. For example, the Smith diagram shows transmission line characteristic impedance close to 50 ohms at ports 98*a* and 98*b* (marker 2—M2) and low transmission loss along the transmission line (from port 98*a* to 98*b*—marker 3—M3). The diagram also shows that structure 90 resonates to a short circuit (low impedance) across port 100. However, structure 90 has high impedance across port 100 at lower frequency 0.86 Ghz and 2.2 Ghz. (markers 4 and 5—M4 and M5).

Owing to the structures 50, 51, 70, 71, 80, 81, 90, and 91 described above, resonant structures can be implemented directly into the PCB structure of balun feeds as well as the arms of diploes 14*a*, 16*a*, and 18*a*. Not only does this simplify the resonant structures over the prior art designs, because of the smaller PCB application, they are easily integrated into the balun feeds as well, whereas prior art designs were unable to be used in such a manner. The balun feeds themselves as vertical impediments can cause just as significant parasitic effects, and this is not addressed in the prior art. The present arrangement provides a solution to that issue as well as being of smaller, more compact, and robust construction.

Figure 22:
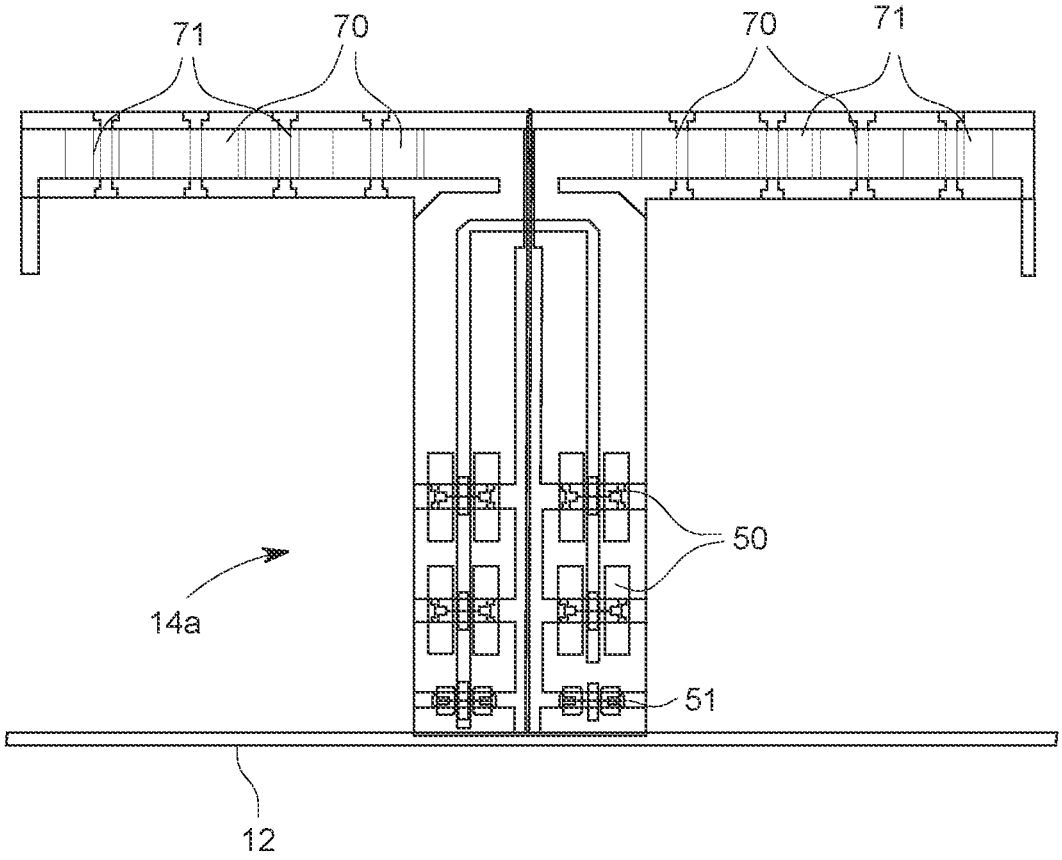
FIG. 22 shows an isolated dipole element with PCB resonant structures in accordance with one embodiment.

Turning now to the placement of the resonant structures on diploes 14*a*, 16*a*, and 18*a*, FIG. 22 illustrates a single dipole element 14*a* having a series of resonant structures 50, 51, 70, and 71 thereon. Resonant structures 50 (mid band) and 51 (high band) are found on the balun feed and structures 70 (mid band) and 71 (high band) are found on the diploe arms of diploe 14*a*.

Regarding the locations of parallel LC resonant circuits 50 and 51 as well as 70 and 71, they are ideally arranged to break up the conductor of element 14*a* into pieces smaller than a half wavelength at the parasitic frequency of which they are attuned. For example, the location of mid band resonant structures 50 and 70 on the balun feed and dipole arms respectively, are arranged to break up those metallic structures of diploe 14*a* into segments that are smaller than ½ wavelength at 2.2 Ghs, as much as possible given space limitations. Even at segments that are at or larger than ½ wavelength there are positive effects, but in some implementations that may not be attainable due to space constraints. In any case, resonant structures 51 and 71 are arranged to break up those metallic structures of diploe 14*a* into segments that are smaller than ½ wavelength at 3.6 Ghs. This location arrangement is done because metallic objects such as diploe 14*a* can resonate at frequencies from mid and high band dipoles 16*a* and 18*a* when they approach a dimension of a half wavelength. This causes severe perturbation of adjacent elements operating at that frequency.

Figure 23:
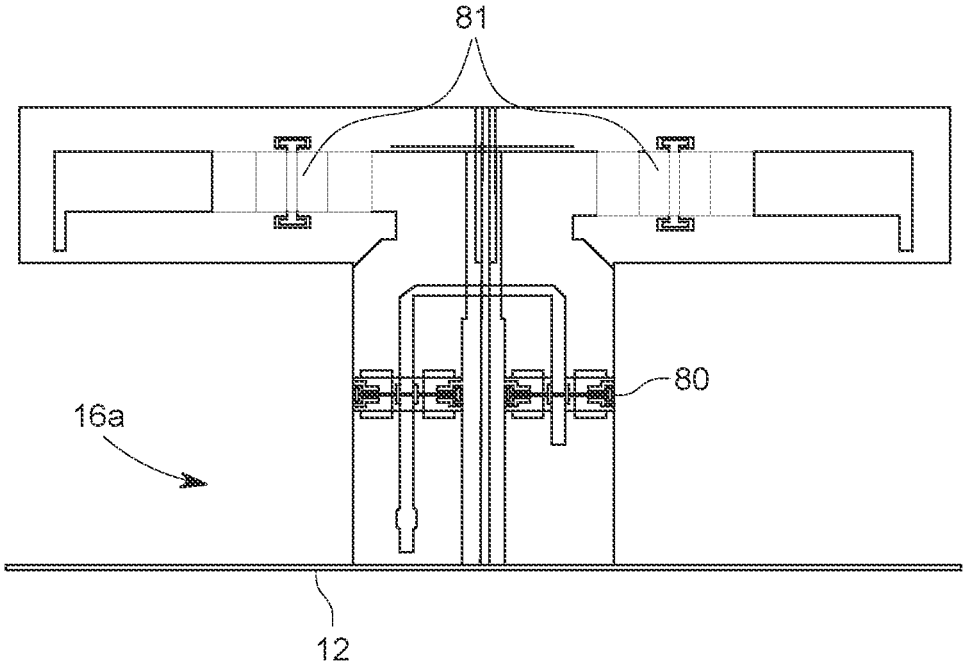
FIG. 23 shows an isolated dipole element with PCB resonant structures in accordance with one embodiment.
Figure 24:
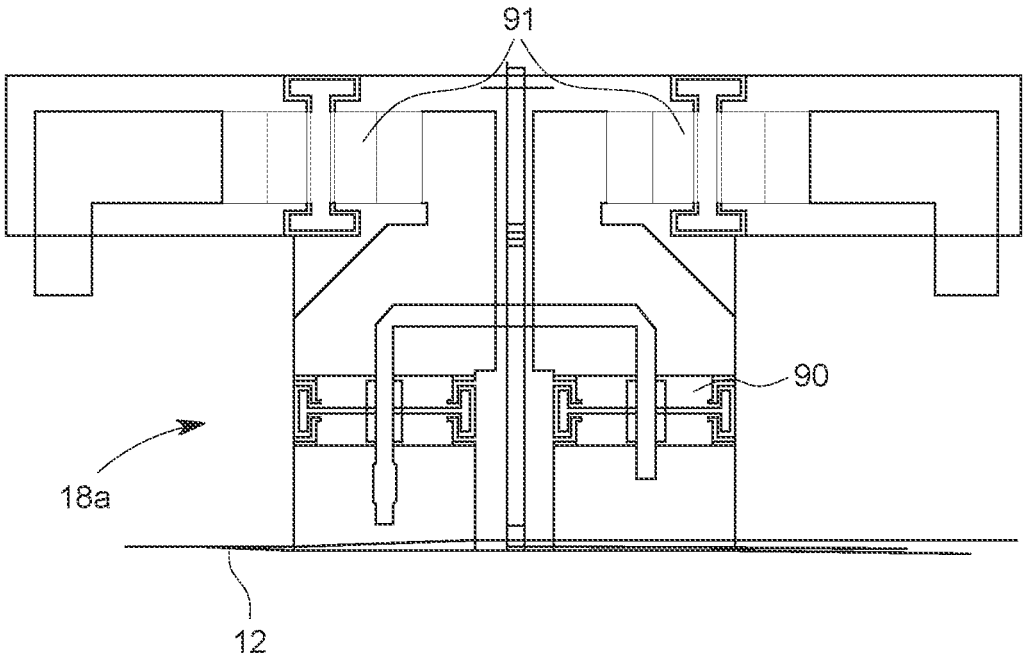
FIG. 24 shows an isolated dipole element with PCB resonant structures in accordance with one embodiment.
Figure 25:
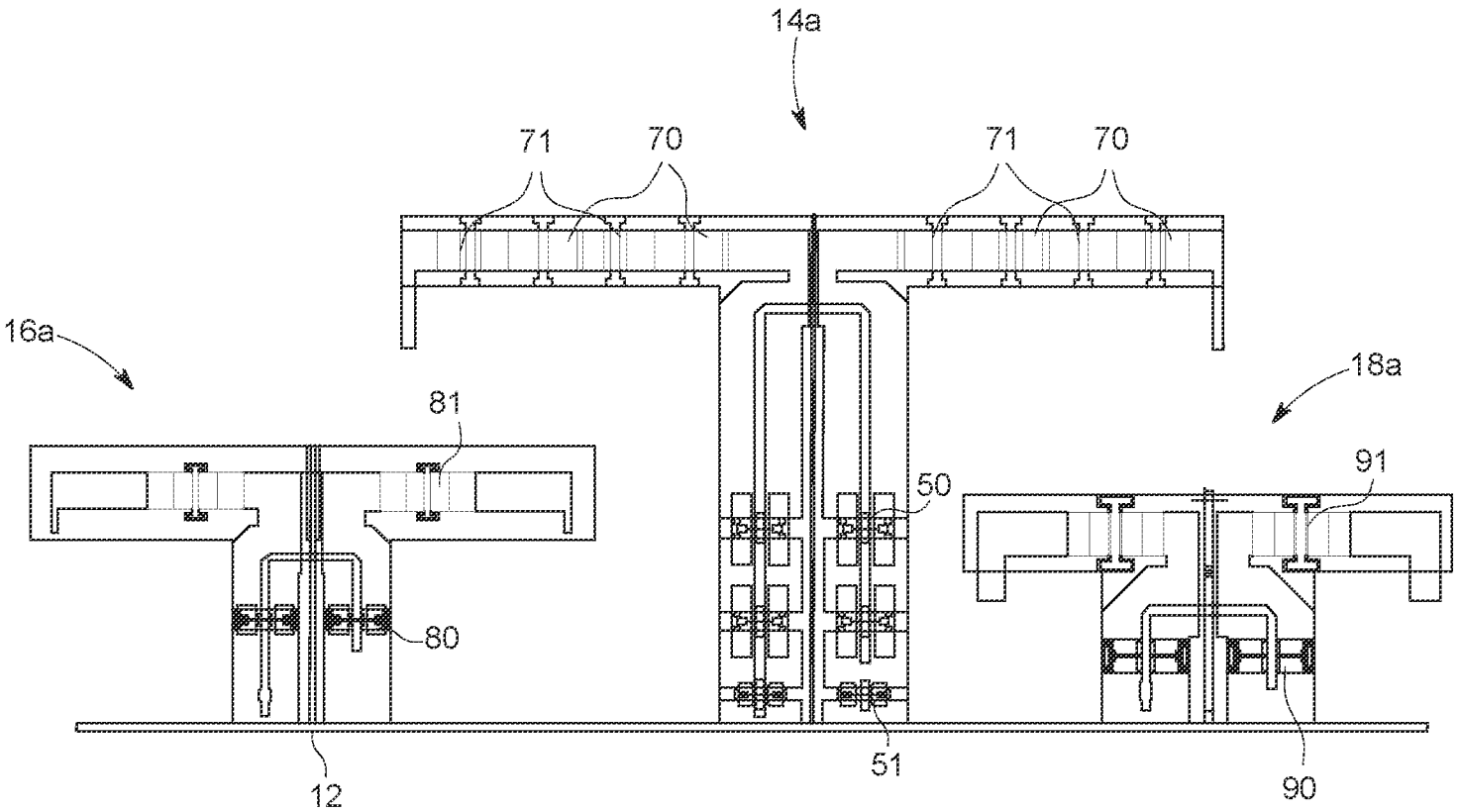
FIG. 25 shows the three dipole element with PCB resonant structures from FIGS. 21-23 on a common reflector in accordance with one embodiment.

FIG. 23 shows the exemplary placement of resonant structures 80 (balun) and 81 (arm) on diploe 16*a* set to reduce parasitic effects at 3.6 Ghz that would otherwise impair the function of high band dipole element 18*a*. FIG. 24 shows the placement of series resonant structures 90 (balun) and 91 (arm) on high frequency dipole 18*a*. FIG. 25 shows all three diploe elements 14*a*, 16*a*, and 18*a* (as contrasted with schematic FIG. 6 showing the same three dipole elements without resonant structures).

Figure 26:
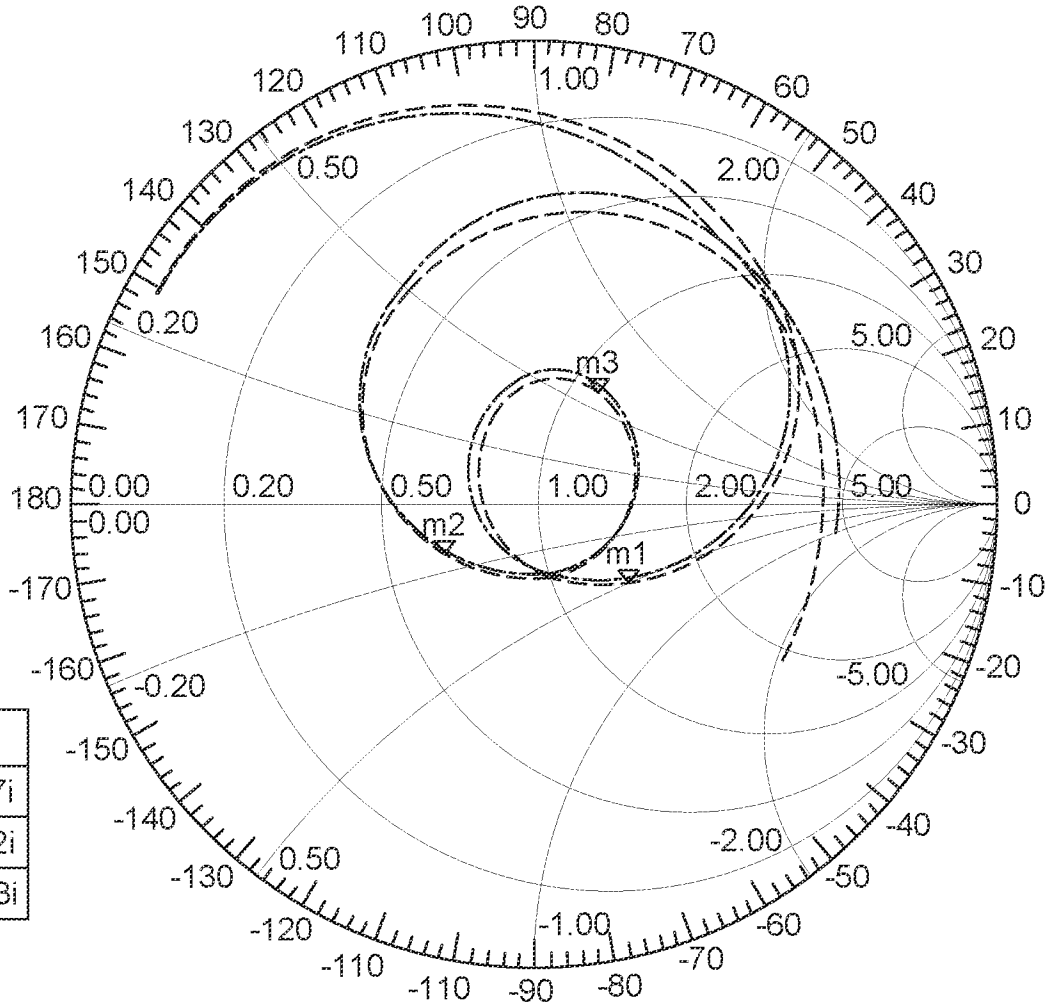
FIG. 26 is a smith diagram for one dipole element with PCB resonant structures in accordance with one embodiment.
Figure 27:
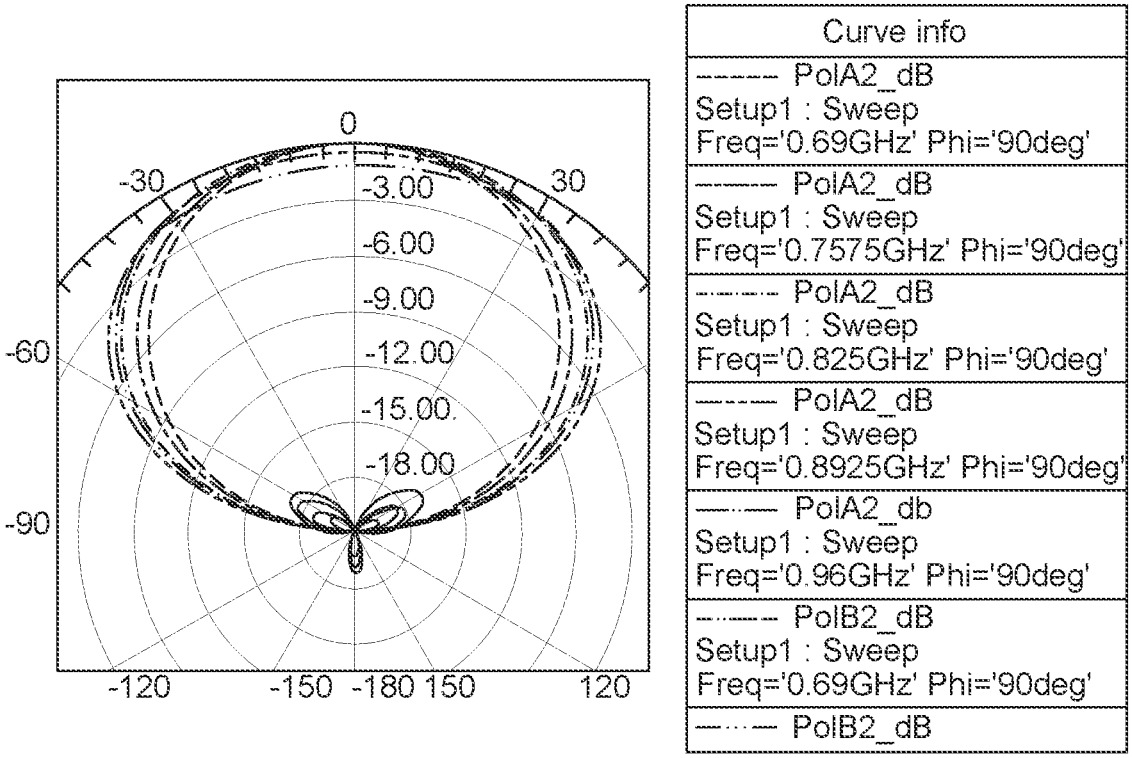
FIG. 27 is an azimuth cut of a radiated pattern plot for one dipole element with PCB resonant structures in accordance with one embodiment.
Figure 28:
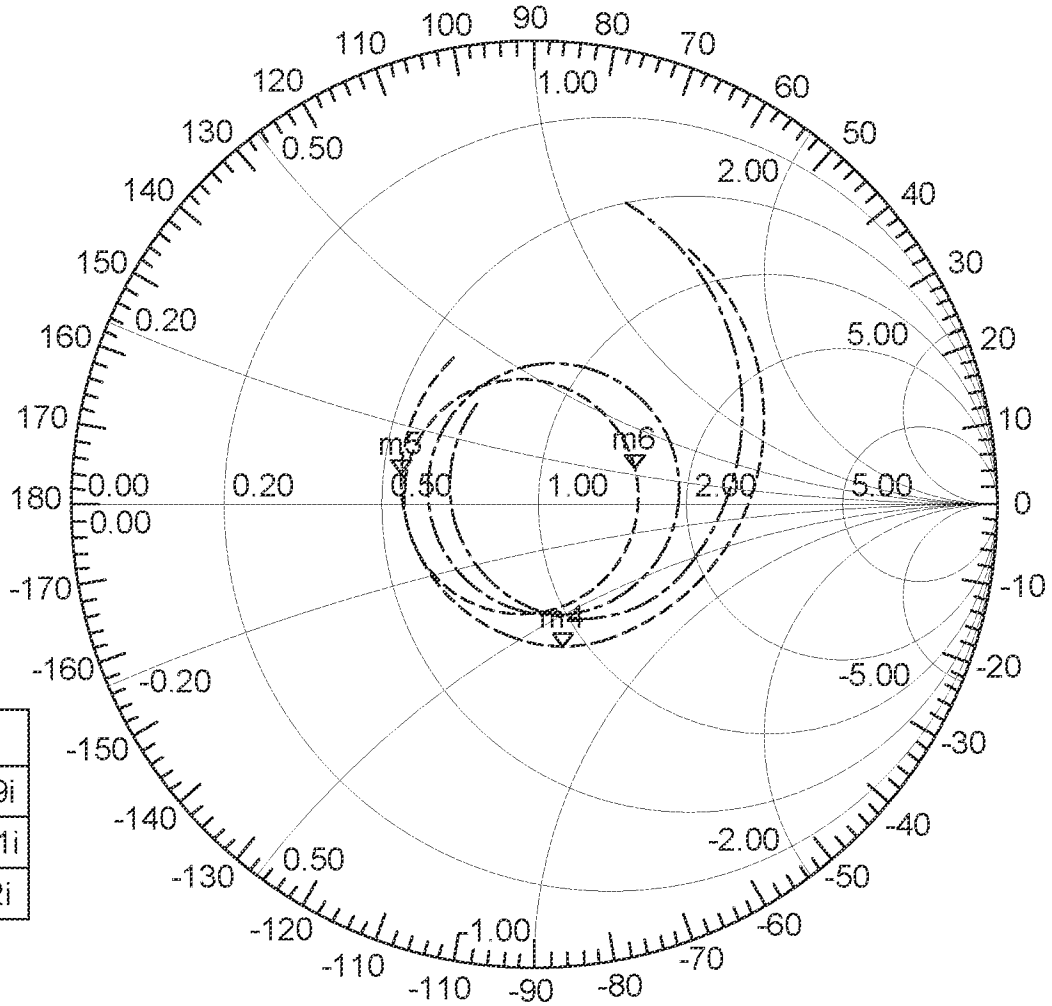
FIG. 28 is a smith diagram for one dipole element with PCB resonant structures in accordance with one embodiment.
Figure 29:
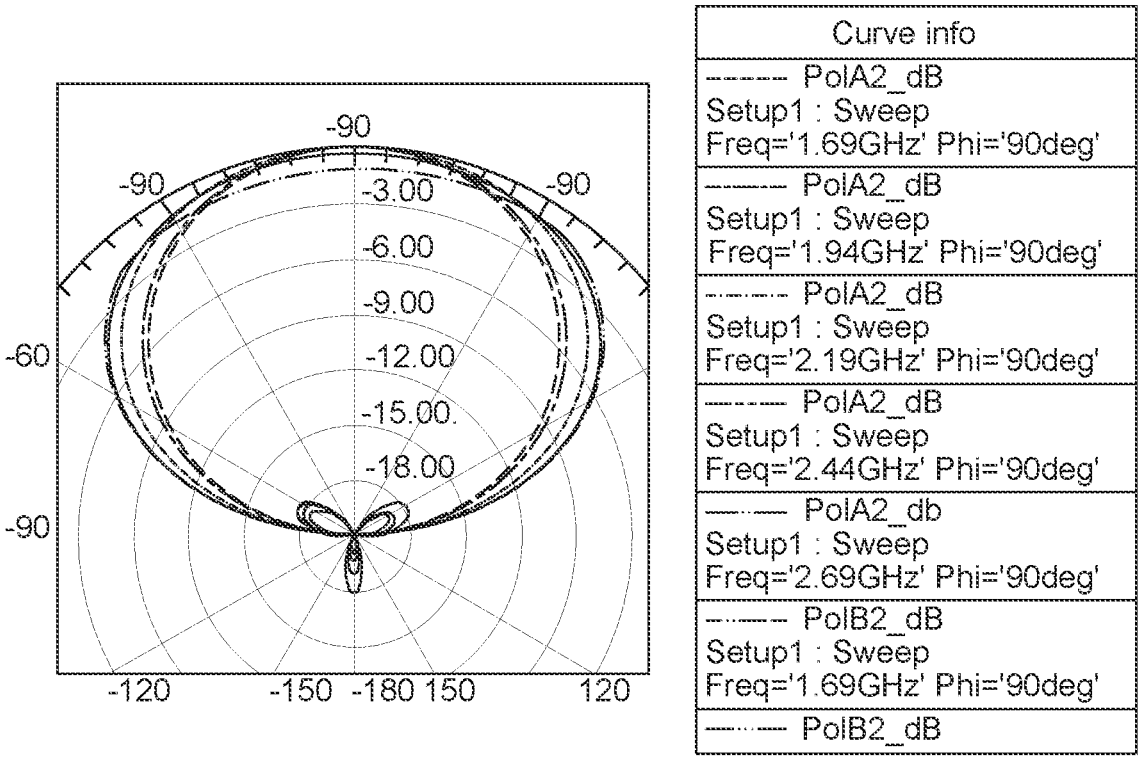
FIG. 29 is an azimuth cut of a radiated pattern plot for one dipole element with PCB resonant structures in accordance with one embodiment.

FIGS. 26 and 27 illustrates two charts showing the resonant structures 50, 51, 70, and 71, implemented on dipole 14*a* do not negatively affect in-band dipole input impedance match (FIG. 26) and radiated pattern shape (FIG. 27) within the low band. FIGS. 28 and 29 illustrates two charts showing the resonant structures 80 and 81, implemented on dipole 16*a* do not negatively affect in-band dipole input impedance match (FIG. 28) and radiated pattern shape (FIG. 29) within the mid band.

Figure 30:
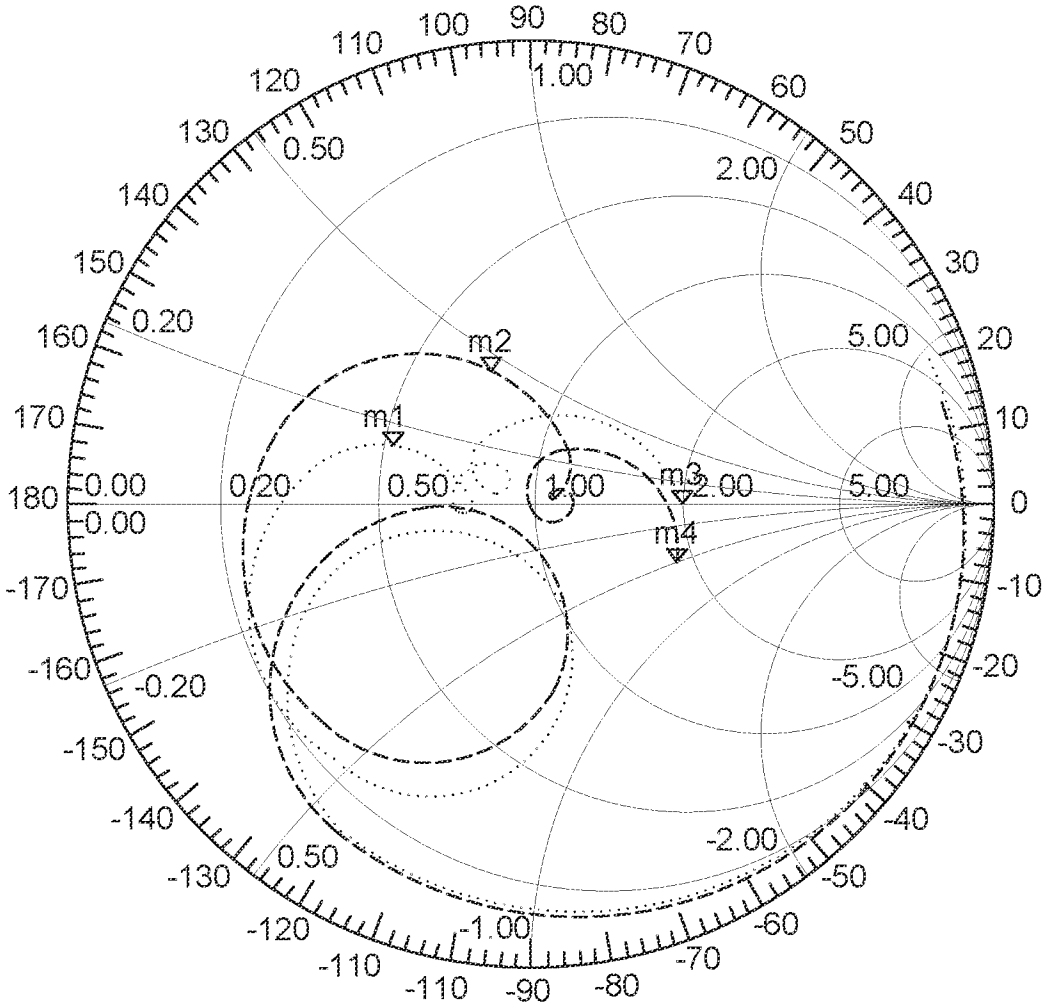
FIG. 30 is a smith diagram for one dipole element with PCB resonant structures in accordance with one embodiment.
Figure 31:
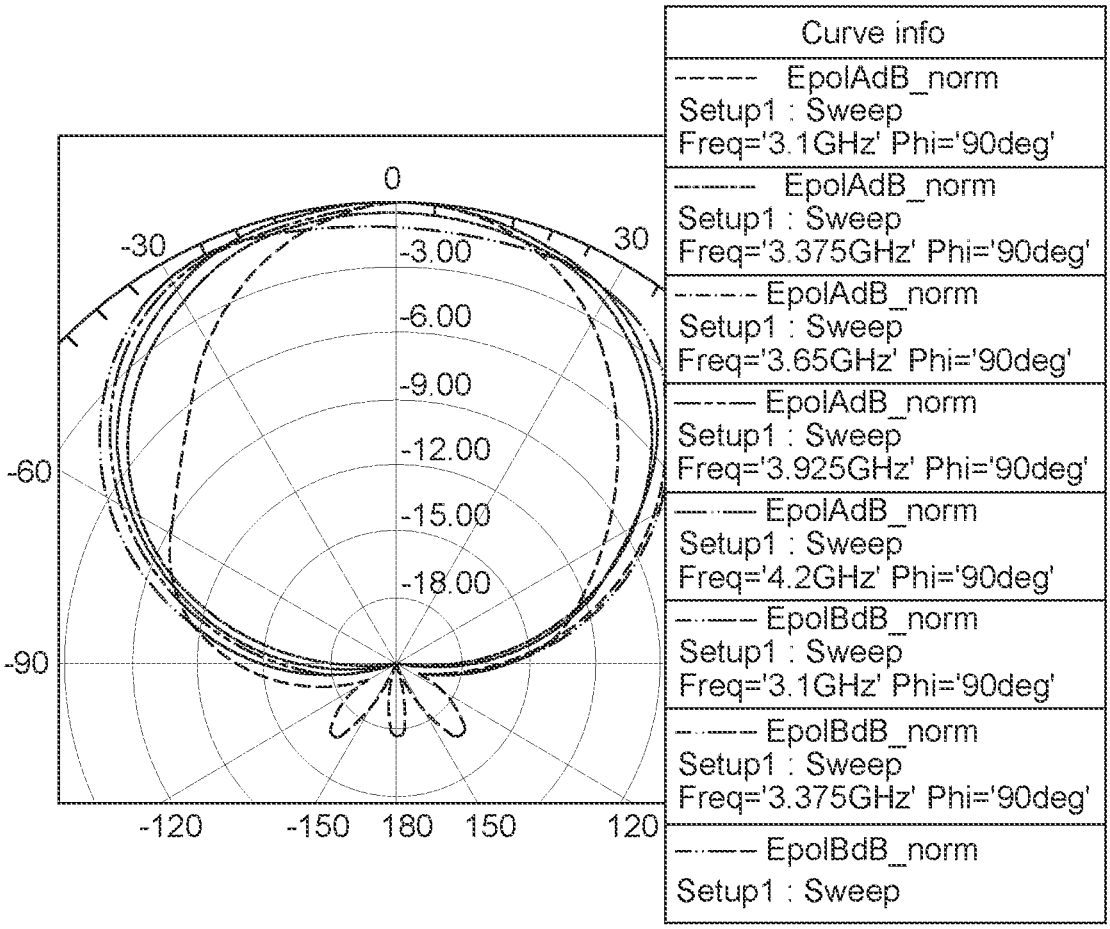
FIG. 31 is an azimuth cut of a radiated pattern plot for one dipole element with PCB resonant structures in accordance with one embodiment.
Figure 32:
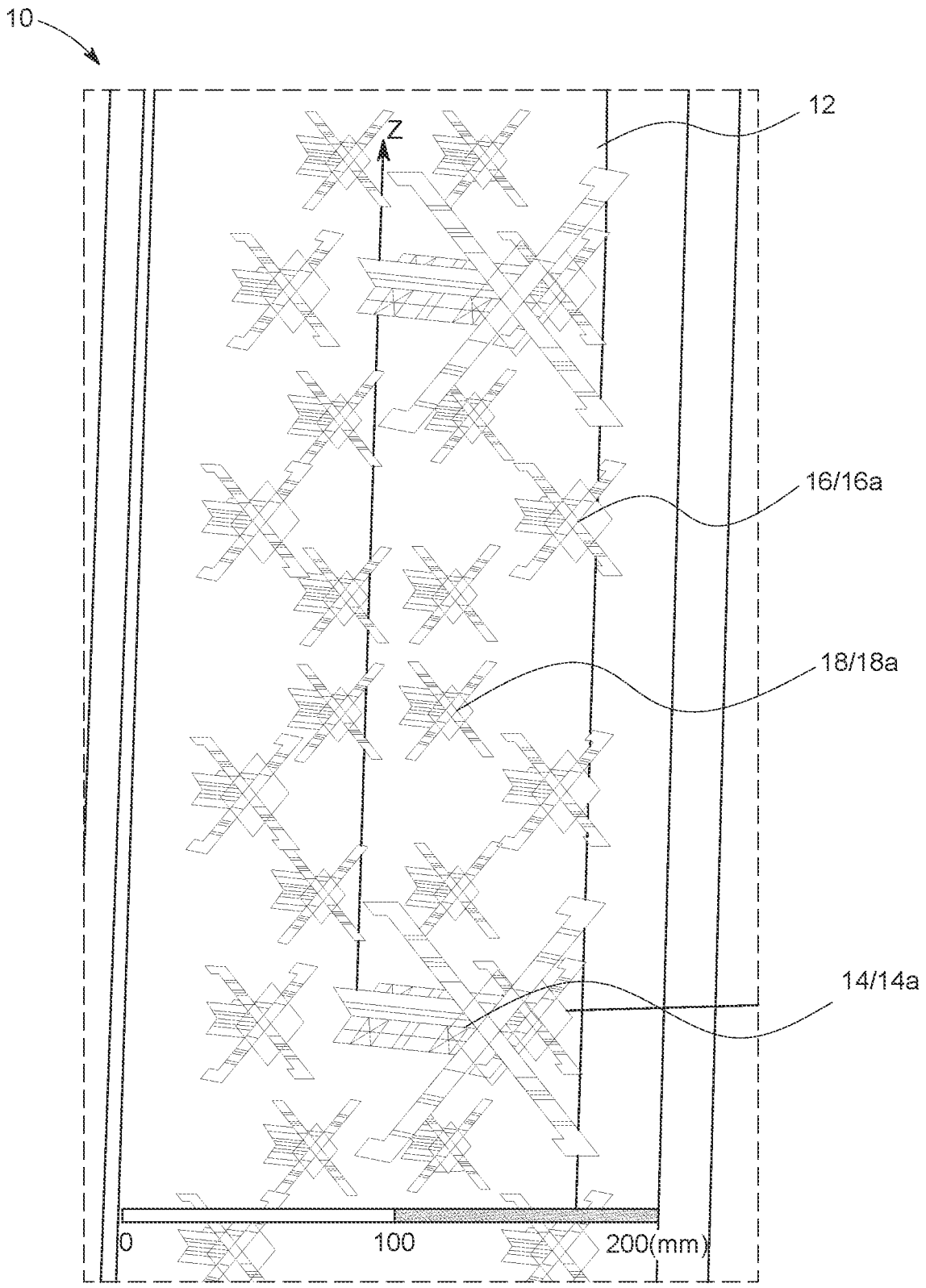
FIG. 32 illustrates multiple frequency arrays on a single reflector panel with dipole elements each having PCB resonant structures in accordance with one embodiment.

FIGS. 30 and 31 illustrates two charts showing the resonant structures 90 and 91, implemented on dipole 18*a* do not negatively affect in-band dipole input impedance match (FIG. 30) and radiated pattern shape (FIG. 31) within the low band. The final FIG. 32 shows a full panel 12 with three frequency range arrays 14 (low band 0.86 Ghz), 16 (mid band 2.2 Ghz), and 18 (high band 3.6 Ghz), composed of elements 14*a*, 16*a*, and 18*a* respectively, to be used in an antenna, such as antenna 10 of FIGS. 3 and 4 or any other multi-frequency cellular antenna. In FIG. 32, arrays 14, 16 and 18 include elements 14*a*, 16*a*, and 18*a*, arranged as single column arrays (2×14*a*, 4×16*a*, 4×18*a*). Owing to the resonant structures on elements 14*a*, 16*a* and 18*a*, each of arrays 14, 16, and 18 are implemented on the single common reflector 12, reducing the overall array volume.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. An antenna for cellular communications, said antenna comprising:

a reflector;

at least a first array of dipole antenna elements on said reflector operating at a first frequency band, said dipole antenna elements of said first array having a printed circuit construction and composed of a balun feed and dipole arms; and at least a second array of dipole antenna elements on said reflector operating at a second frequency band said dipole antenna elements of said first array having a printed circuit construction and composed of a balun feed and dipole arms;

wherein said dipole antenna elements of said first array include one or more resonant structures causing a substantially closed circuit at said first frequency band and a substantially open circuit at said second frequency band, wherein said resonant structures on said dipole antenna elements of said first array are located at least in part on said balun feed of said dipole antenna elements.

2. The antenna as claimed in claim 1, wherein said one or more resonant structures on said dipole antenna elements of said first array are located at least in part on said dipole arms of said dipole antenna elements.

3. The antenna as claimed in claim 1, wherein said one or more resonant structures on said dipole antenna elements of said first array are located on both said balun feed and said dipole arms of said dipole antenna elements.

4. The antenna as claimed in claim 1, wherein said one or more resonant structures on said dipole antenna elements of said first array are constructed as printed circuit board resonant structures.

5. The antenna as claimed in claim 1, wherein said antenna further comprises at least a third array of dipole antenna elements on said reflector operating at a third frequency band, said dipole antenna elements of said third array having a printed circuit construction and composed of a balun feed and dipole arms.

6. The antenna as claimed in claim 5 wherein said dipole antenna elements of said first array include one or more resonant structures causing a substantially closed circuit at said first frequency band and a substantially open circuit at said second frequency band, and wherein said dipole antenna elements of said first array include one or more resonant structures causing a substantially closed circuit at said first frequency band and a substantially open circuit at said third frequency band.

7. The antenna as claimed in claim 5, wherein said first antenna array operates at substantially 0.86 Ghz (low band), said second antenna array operates at substantially 2.2 Ghz (mid band), and said third antenna array operates at substantially 3.6 Ghz (high band).

8. The antenna as claimed in claim 5, wherein said one or more resonant structures of said antenna elements of said second antenna array are constructed as printed circuit board LC parallel resonant structures.

9. The antenna as claimed in claim 1, wherein said dipole antenna elements of said second array include one or more resonant structures causing a substantially closed circuit at said second frequency band and a substantially open circuit at said third frequency band.

10. The antenna as claimed in claim 1, wherein said one or more resonant structures of said antenna elements of said first antenna array are constructed as printed circuit board LC parallel resonant structures.

11. The antenna as claimed in claim 1, wherein said dipole antenna elements of said third array include one or more resonant structures causing a substantially closed circuit at said third frequency band and a substantially open circuit at said first and second frequency bands.

12. The antenna as claimed in claim 11, wherein said one or more resonant structures of said antenna elements of said third antenna array are constructed as printed circuit board CLC series resonant structures.

13. An antenna for cellular communications, said antenna comprising:

a reflector;

at least a first array of antenna elements on said reflector operating at a first frequency band, said dipole antenna elements of said first array having a printed circuit construction and composed of a balun feed and dipole arms; and at least a second array of antenna elements on said reflector operating at a second frequency band, said dipole antenna elements of said second array having a printed circuit construction and composed of a balun feed and dipole arms;

wherein said printed circuit construction of said antenna elements of said first array include one or more printed circuit resonant structures causing a substantially closed circuit at said first frequency band and a substantially open circuit at said second frequency band.

* * * * *